US011555273B2

(12) United States Patent
Gingras et al.

(10) Patent No.: US 11,555,273 B2
(45) Date of Patent: Jan. 17, 2023

(54) FLOW-ALTERING REFINER SEGMENT

(71) Applicant: ANDRITZ INC., Alpharetta, GA (US)

(72) Inventors: Luc Gingras, Harrogate (GB); Tom Berger, Knoxville, TN (US); Yves Raymond, Milton, PA (US); Long Nguyen, Hugesville, PA (US)

(73) Assignee: ANDRITZ INC., Alpharetta, GA (US)

( * ) Notice: Subject to any disclaimer, the term of this patent is extended or adjusted under 35 U.S.C. 154(b) by 0 days.

(21) Appl. No.: 17/521,339

(22) Filed: Nov. 8, 2021

(65) Prior Publication Data

US 2022/0333304 A1 Oct. 20, 2022

Related U.S. Application Data

(60) Provisional application No. 63/175,752, filed on Apr. 16, 2021.

(51) Int. Cl.
*D21D 1/26* (2006.01)

(52) U.S. Cl.
CPC ..... *D21D 1/26* (2013.01)

(58) Field of Classification Search
CPC ..... D21D 1/26; D21D 21/30; D21D 21/303; D21D 21/306
USPC ..... 241/220, 261
See application file for complete search history.

(56) References Cited

U.S. PATENT DOCUMENTS

2021/0062422 A1* 3/2021 Huhtanen ..... D21D 1/22

FOREIGN PATENT DOCUMENTS

CA 2493678 A1 * 7/2005 ..... B02C 7/12
EP 2304101 B1 9/2013
EP 3786357 A1 3/2021

OTHER PUBLICATIONS

International Application No. PCT/US2022/018448, International Search Report and Written Opinion dated Jun. 7, 2022, 14 pages.
International Application No. PCT/US2022/018451, International Search Report and Written Opinion dated Jun. 3, 2022, 14 pages.

* cited by examiner

*Primary Examiner* — Shelley M Self
*Assistant Examiner* — Smith Oberto Bapthelus
(74) *Attorney, Agent, or Firm* — Kilpatrick Townsend & Stockton LLP

(57) ABSTRACT

Refiner plate elements for a conical mechanical refiner include: a rotor plate element including at least one rotor plate segment having a feedstock inlet opening disposed at a first end of the rotor plate segment; and a rotor plate segment refining area disposed between the feedstock inlet opening and a second end of the rotor plate segment. The refiner plate elements may further include: a stator plate element including at least one stator plate segment having a stator plate segment refining area; and first and second attaching rails configured to couple to the stator plate segment to a stator support frame of the conical mechanical refiner. A separation between the first attaching rail and the second attaching rail that is not covered by the stator plate segment is configured to form a feedstock outlet opening.

11 Claims, 17 Drawing Sheets

FLOW-ALTERING REFINER SEGMENT

CROSS-REFERENCE TO RELATED APPLICATIONS

This application claims the benefit of U.S. Provisional Application No. 63/175,752, filed Apr. 16, 2021, the contents of which is hereby incorporated herein by reference in its entirety.

BACKGROUND

Unless otherwise indicated herein, the materials described in this section are not prior art to the claims in this application and are not admitted to be prior art by inclusion in this section.

Conical mechanical refiners for treating fibrous material typically include two elements substantially opposite to one another. One of the refiner elements, the rotor, is arranged to move with respect to a stationary refiner element, the stator. Between the rotor and the stator, a refiner gap is created into which the fibrous material to be refined is fed. The refiner elements include the refining surfaces that carry out the actual refining. The refining surfaces may be one integral structure or they may consist of a plurality of refining surface segments arranged adjacent to one another forming the refining surface.

FIG. 1 is a simplified diagram illustrating a conical mechanical refiner 100. The conical mechanical refiner 100 may include a conical rotor 110, and a conical stator 120. Rotation of the conical rotor 110 around an axis of rotation "R" may be caused by a motor 130 via a shaft 135. Rotor refining plates 115 may be disposed on the surface of the conical rotor 110 and may rotate with the conical rotor 110, and stator refining plates 125 may be disposed on the surface of the conical stator 120 and may be stationary. A refining gap 140 may be formed between the conical rotor 110, and the conical stator 120.

In the case of a conical mechanical refiner 100 shown in FIG. 1, feedstock 150 such as wood pulp or cellulose is fed into the internal portion of the conical rotor 110 and into the refining gap 140 via a large number of substantially homogeneously distributed openings 117 cut across the rotor refining plates 115 or rotor refining cone. The feedstock 150 travels across the rotor refining plates 115 and stator refining plates 125. The stator refining plates 125 or stator cone also have similar openings 127 that are substantially homogeneously distributed over their surface through which the refined feedstock 155 flows out of the conical mechanical refiner 100. On the remaining surface of both rotor and stator plate segments or cones (the surface that surrounds all the openings), an array of bars and grooves is disposed and provides the refining treatment, as the rotor turns against the stator.

It has been observed in practice that pulp treated with the type of refiner and plate designs illustrated in FIG. 1 show that a significant proportion of fibers are either untreated or very lightly treated by the refining action, indicating that there is a significant amount of stock that possibly travels directly or almost directly through rotor openings directly into stator openings, hence being barely treated in the refining gap. There is a need to improve the flow pattern of pulp stock in this type of refiner construction in order to provide a more homogenous fiber treatment and ensure a better overall pulp development.

SUMMARY

Apparatuses for improving the flow pattern of pulp stock in a conical mechanical refiner are provided.

According to various aspects there is provided refiner plate elements for a conical mechanical refiner. In some aspects, the refiner plate elements may include: a rotor plate element including at least one rotor plate segment having at least one feedstock inlet opening disposed at a first end of the at least one rotor plate segment; and a rotor plate segment refining area disposed between the at least one feedstock inlet opening and a second end of the at least one rotor plate segment. The refiner plate elements may further include: a stator plate element including at least one stator plate segment having a stator plate segment refining area; a first attaching rail configured to couple to the at least one stator plate segment at a first edge portion of the at least one stator plate segment; and a second attaching rail configured to couple to the at least one stator plate segment at a second edge portion of the at least one stator plate segment opposite the first edge portion.

The first attaching rail and the second attaching rail may be configured to attach the at least one stator plate segment to a stator support frame of the conical mechanical refiner. A separation between the first attaching rail and the second attaching rail that is not covered by the at least one stator plate segment is configured to form at least one feedstock outlet opening.

According to various aspects there is provided refiner plate elements for a conical mechanical refiner. In some aspects, the refiner plate elements may include: a stator plate element including at least one stator plate segment having a stator plate segment refining area; a first attaching rail configured to couple to the at least one stator plate segment at a first edge portion of the at least one stator plate segment; and a second attaching rail configured to couple to the at least one stator plate segment at a second edge portion of the at least one stator plate segment opposite the first edge portion of the at least one stator plate segment. The first attaching rail and the second attaching rail are configured to attach the at least one stator plate segment to a stator support frame of the conical mechanical refiner.

The refiner plate elements may further include: a rotor plate element including: at least one rotor plate segment having a rotor plate segment refining area; a third attaching rail configured to couple to the at least one rotor plate segment at a first edge portion of the at least one rotor plate segment; and a fourth attaching rail configured to couple to the at least one rotor plate segment at a second edge portion of the at least one rotor plate segment opposite the first edge portion of the at least one rotor plate segment.

The first attaching rail and the second attaching rail are configured to attach the at least one stator plate segment to a stator support frame of the conical mechanical refiner, and a separation between the first attaching rail and the second attaching rail is configured to form at least one feedstock outlet opening that is not covered by the at least one stator plate segment.

The third attaching rail and the fourth attaching rail are configured to attach the at least one rotor plate segment to a rotor support frame of the conical mechanical refiner, and a separation between the third attaching rail and the fourth attaching rail that is not covered by the at least one rotor plate segment is configured to form at least one feedstock inlet opening.

According to various aspects there is provided stator plate element for a conical mechanical refiner. In some aspects, the stator plate element may include: at least one stator plate segment having a stator plate segment refining area; a first attaching rail configured to couple to the at least one stator plate segment at a first edge portion of the at least one stator plate segment; and a second attaching rail configured to couple to the at least one stator plate segment at a second edge portion of the at least one stator plate segment opposite the first edge portion.

The first attaching rail and the second attaching rail are configured to attach the at least one stator plate segment to a conical stator support frame of the conical mechanical refiner, and a separation between the first attaching rail and the second attaching rail that is not covered by the at least one stator plate segment is configured to form at least one feedstock outlet opening.

According to various aspects there is provided rotor plate element for a conical mechanical refiner. In some aspects, the rotor plate element may include: at least one rotor plate segment having a rotor plate segment refining area; a first attaching rail configured to couple to the at least one rotor plate segment at a first edge portion of the at least one rotor plate segment; and a second attaching rail configured to couple to the at least one rotor plate segment at a second edge portion of the at least one rotor plate segment opposite the first edge portion of the at least one rotor plate segment.

The first attaching rail and the second attaching rail are configured to attach the at least one rotor plate segment to a rotor support frame of the conical mechanical refiner, and a separation between the first attaching rail and the second attaching rail that is not covered by the at least one rotor plate segment is configured to form at least one feedstock inlet opening.

BRIEF DESCRIPTION OF THE DRAWINGS

Aspects and features of the various embodiments will be more apparent by describing examples with reference to the accompanying drawings, in which.

DETAILED DESCRIPTION

While certain embodiments are described, these embodiments are presented by way of example only, and are not intended to limit the scope of protection. The apparatuses, methods, and systems described herein may be embodied in a variety of other forms. Furthermore, various omissions, substitutions, and changes in the form of the example methods and systems described herein may be made without departing from the scope of protection.

Conical mechanical refiners for treating fibrous material include a conical rotor that is arranged to move with respect to a stationary conical stator. A refiner gap is created between the conical rotor and the conical stator, into which the fibrous material to be refined is fed. The fibrous material may be fed into the middle of the conical rotor and into the refining gap through a large number of homogeneously distributed openings. The fibrous material may exit the conical mechanical refiner through similar openings that are homogeneously distributed over the surface of the conical stator. The conical rotor and the conical stator include the refining surfaces that perform the refining of the fibrous material.

Figure 1:
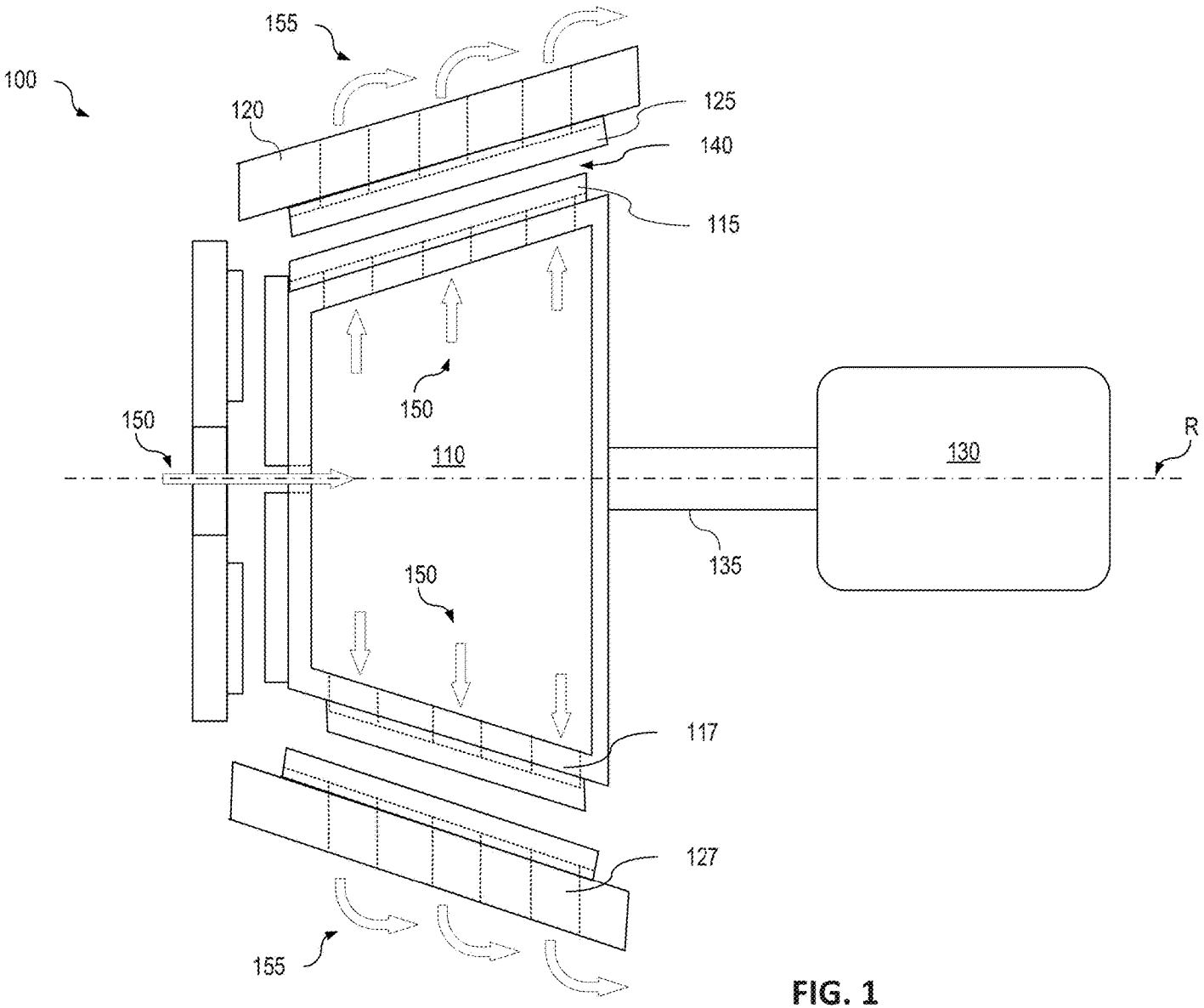
FIG. 1 is a simplified diagram illustrating a conical mechanical refiner according to some aspects of the present disclosure.
Figure 2:
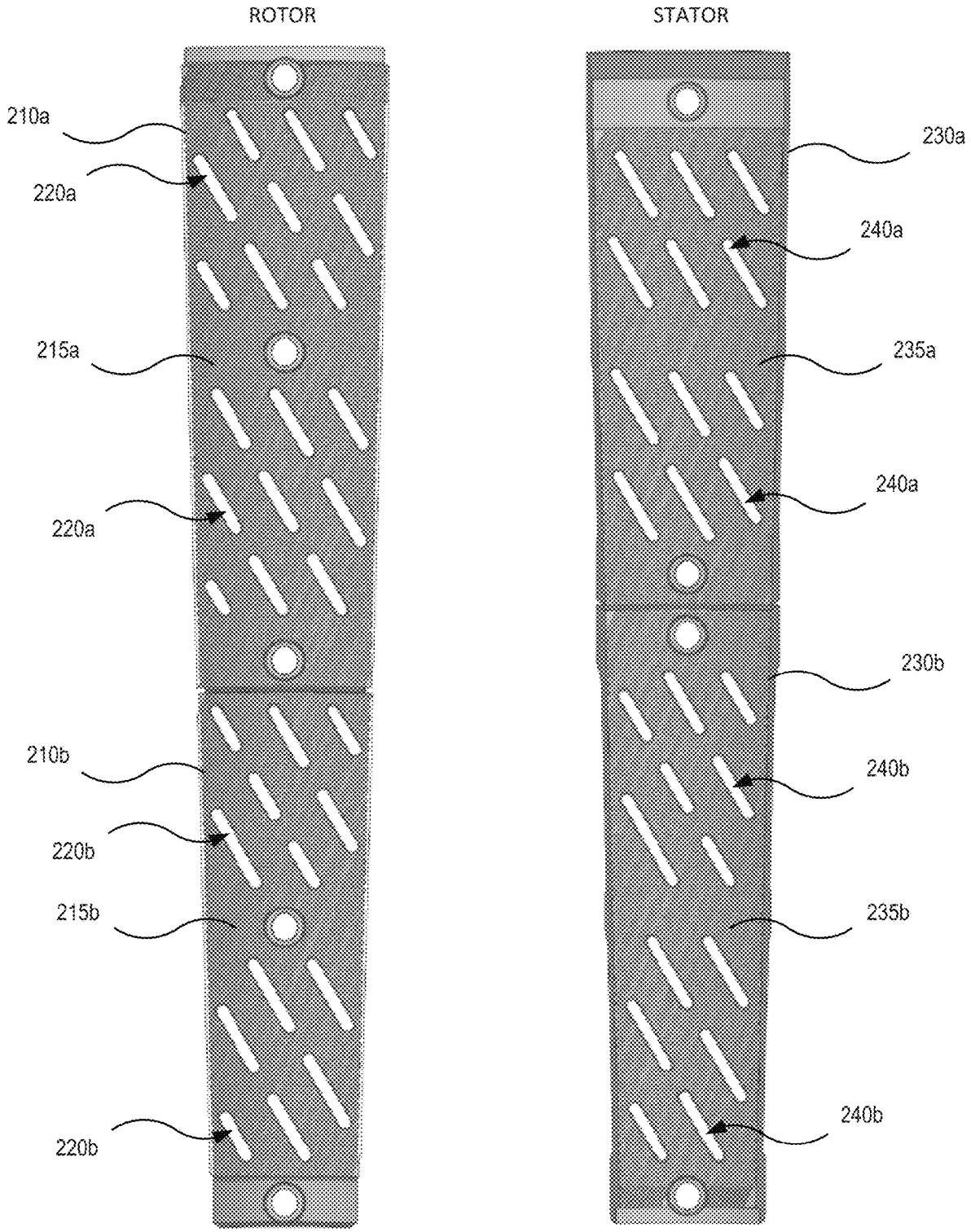
FIG. 2 is a diagram illustrating the typical construction of rotor segments and stator segments used for a conical mechanical refiner of the type illustrated in FIG. 1.

FIG. 2 illustrates the typical construction of rotor segments 210*a* and 210*b* and stator segments 230*a* and 230*b* normally used for a conical mechanical refiner of the type illustrated in FIG. 1. The rotor segments 210*a* and 210*b* may be portions of the conical rotor 110 and the stator segments 230*a* and 230*b* may be portions of the conical stator 120. As shown in FIG. 2, inlet openings 220*a*, 220*b* in the rotor segments 210*a*, 210*b* for conducting feedstock in to the refining gap span the surface of the rotor refining areas 215*a*, 215*b*. Similarly, outlet openings 240*a*, 240*b* in the stator segments 230*a*, 230*b* for conducting refined feedstock out of the refining gap span the surface of the stator refining areas 235*a*, 235*b*. As the rotor rotates, portions of the inlet openings 220*a*, 220*b* of the rotor segments 210*a*, 210*b* can align with portions of the outlet openings 240*a*, 240*b* of the stator. Due to this geometry, the feedstock flow that enters through the inlet openings 220*a*, 220*b* in the rotor refining areas 215*a*, 215*b* can also exit through the outlet openings 240*a*, 240*b* in the stator refining areas 235*a*, 235*b*. Thus, a direct route for the feedstock in and out of the refining zone without being refined may be created when the opposing openings line up.

According to aspects of the present disclosure, the conical rotor and the conical stator may be made up of a plurality of refiner plate elements. Each of the refiner plate elements may include a plurality of segments that form the surfaces of the conical rotor and the conical stator. The rotor plate segments may include one or more inlet locations configured to conduct feedstock into the refining gap as well as one or more refining areas configured to refine the feedstock. The stator plate segments may include one or more refining areas configured to refine the feedstock, but may not include outlet openings to conduct refined feedstock out of the refining gap. Rather, the stator plate segments may be configured for mounting on attaching rails, and the attaching rails may be configured to mount the stator plate segments to provide outlet openings between the stator plate segments or at opposite ends of the stator plate segments to conduct refined feedstock out of the refining gap.

For each rotor plate segment, one or more inlet locations for feedstock may be defined outside of the refining areas such that the inlet locations are separated from the refining areas of the rotor plate segment. One or more outlet locations for the feedstock may be defined between the stator plate segments or at opposite ends of the stator plate segments based on the positioning of the stator plate segments on the attaching rails. The refined feedstock may flow through the outlet openings formed between the attaching rails adjacent to the ends of the stator plate segmentstator plate segments. In some implementations, the refined feedstock may flow through the outlet openings formed by the attaching rails at opposite ends of stator plate segmentstator plate segments.

In some implementations, the one or more inlet locations on the rotor plate segments may be covered or partially covered by the rotor plate segment refining areas. The inlet location and the outlet location may be separated from each other by a specified axial distance along a surface of the rotor plate segment and/or the surface of the stator plate segment. Refining areas of the stator plate segment and the rotor plate segment may be disposed on the surfaces of the segments in the areas between the inlet locations on the rotor plate segments and the outlet locations between the stator plate segments or at opposite ends of the stator plate segments. The feedstock thus can flow along the rotor and stator plate segments over the length of the refining zone in order to travel from the inlet location to the outlet location.

Figure 3A:
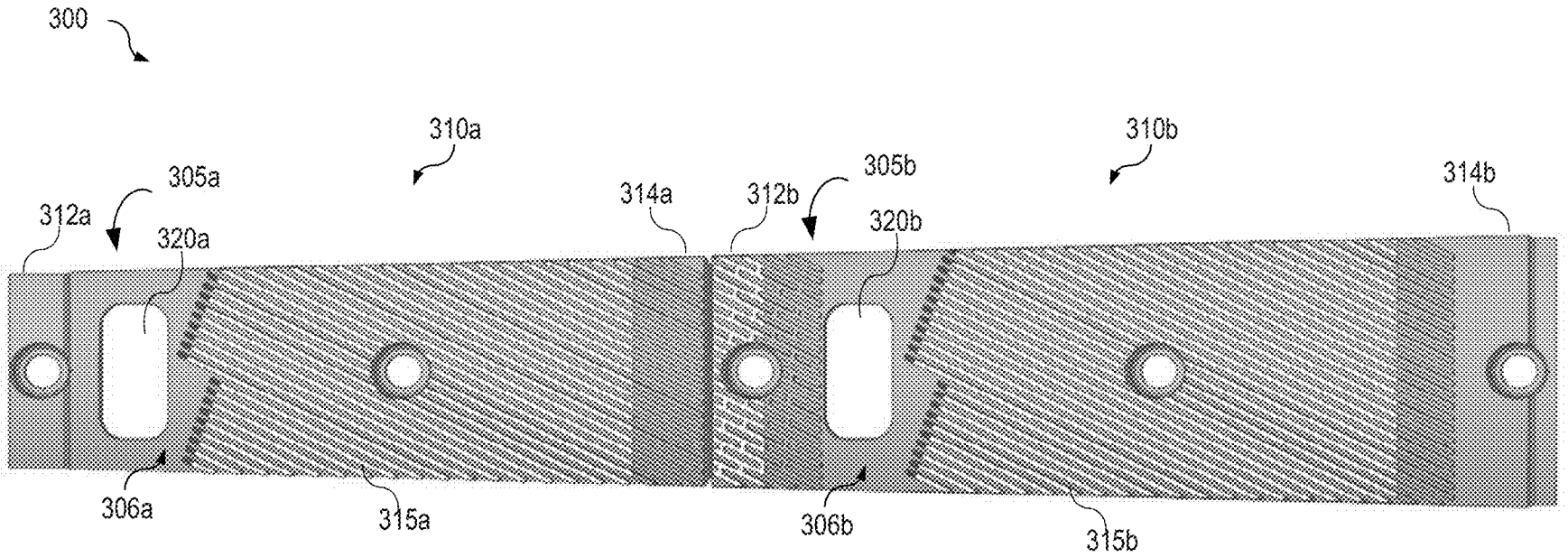
FIG. 3A is a diagram illustrating an example of a rotor plate element according to some aspects of the present disclosure.

FIG. 3A is a diagram illustrating an example of a rotor plate element 300 according to some aspects of the present disclosure. A plurality of rotor plate elements 300 may be disposed around a conical rotor support frame to form the conical-shaped rotor 110 illustrated in FIG. 1. The rotor plate element 300 may include rotor plate segments 310*a* and 310*b* arranged in a longitudinal direction with respect to an axis of rotation "R" of the conical-shaped rotor 110 illustrated in FIG. 1. A first end 312*a* of the rotor plate segment 310*a* may be disposed on the conical rotor support frame toward a smaller end of the cone. A second end 314*a* of the rotor plate segment 310*a* may be disposed adjacent a first end 312*b* of the rotor plate segment 310*b* at an intermediate point on the conical rotor support frame. A second end 314*b* of the rotor plate segment 310*b* may be disposed on the conical rotor support frame towards a larger end of the cone.

Each rotor plate segment 310*a*, 310*b* may include one or more inlet openings 320*a*, 320*b* and one or more rotor refining areas 315*a*, 315*b*. The one or more inlet openings 320*a*, 320*b* may be disposed at the first ends 312*a*, 312*b* of the rotor plate segments 310*a*, 310*b*. The one or more inlet openings 320*a*, 320*b* may enable feedstock to flow from a back side 305*a*, 305*b* of the rotor plate segments 310*a*, 310*b* to the front side 306*a*, 306*b* of the rotor plate segments 310*a*, 310*b* and then over the refining areas 315*a*, 315*b*. The rotor refining areas 315*a*, 315*b* may include patterns of bars and grooves and/or other features designed to refine the feedstock.

While one rotor refining area 315*a*, 315*b* is shown on each of the rotor plate segment 310*a*, 310*b*, the rotor plate segments may include more than one refining area and each refining area may have the same or different patterns of bars and grooves and/or other features configured to refine feedstock. In some implementations, one or more inlet openings may be provided in areas of the rotor plate segments between the more than one refining areas.

Figure 3B:
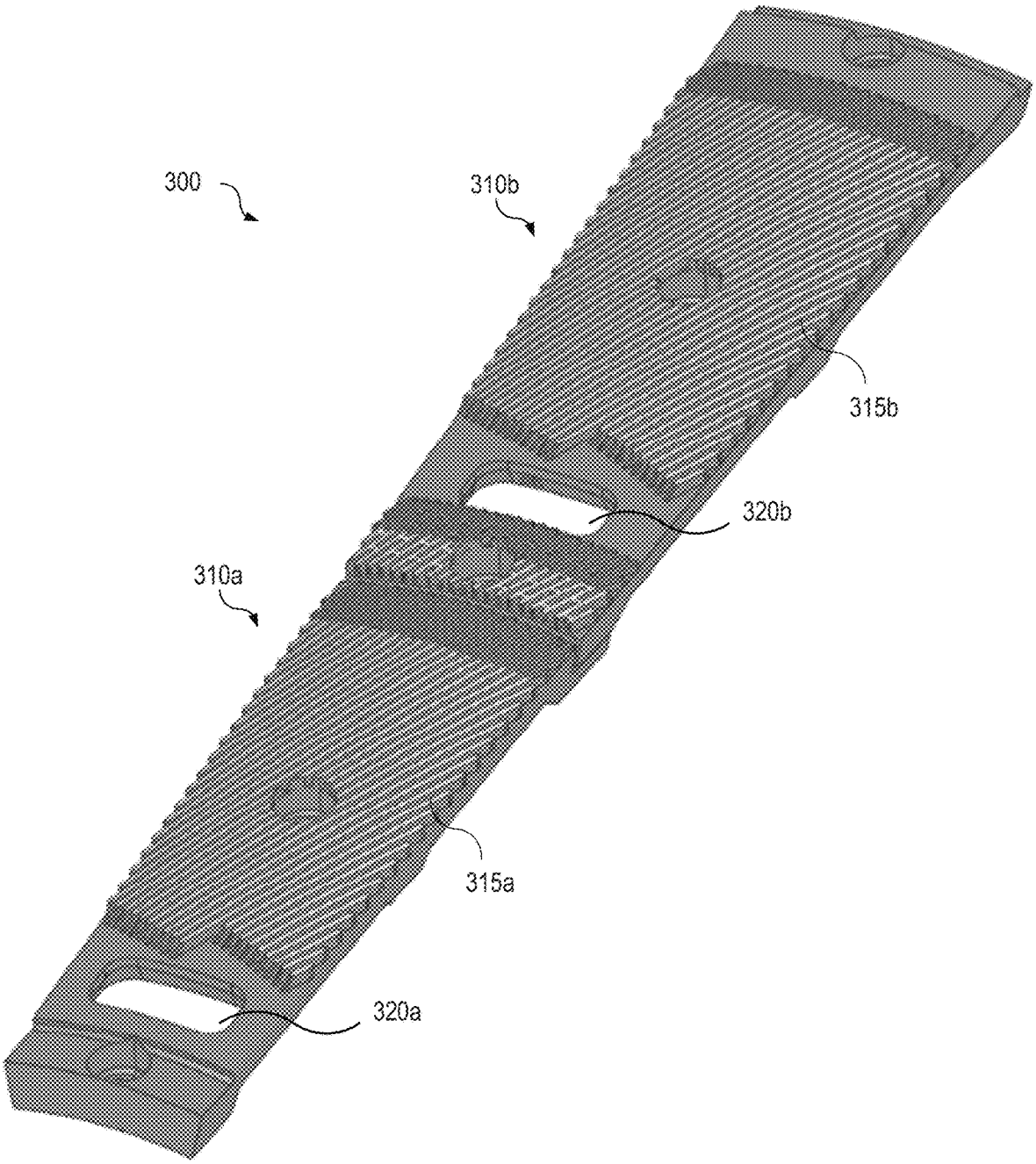
FIG. 3B is a perspective view of the rotor plate element of FIG. 3A according to some aspects of the present disclosure.

In some implementations, each rotor plate element may include two or more rotor plate segments arranged in a longitudinal direction with respect to an axis of rotation "R" of the conical rotor. In some implementations, the conical mechanical refiner may accommodate only one rotor plate segment per rotor plate element. In such implementations, the rotor plate segment may include one inlet opening location having one or more inlet openings, or multiple inlet opening locations each including one or more inlet openings. FIG. 3B is a perspective view of the rotor plate element 300 of FIG. 3A according to some aspects of the present disclosure.

Figure 4A:
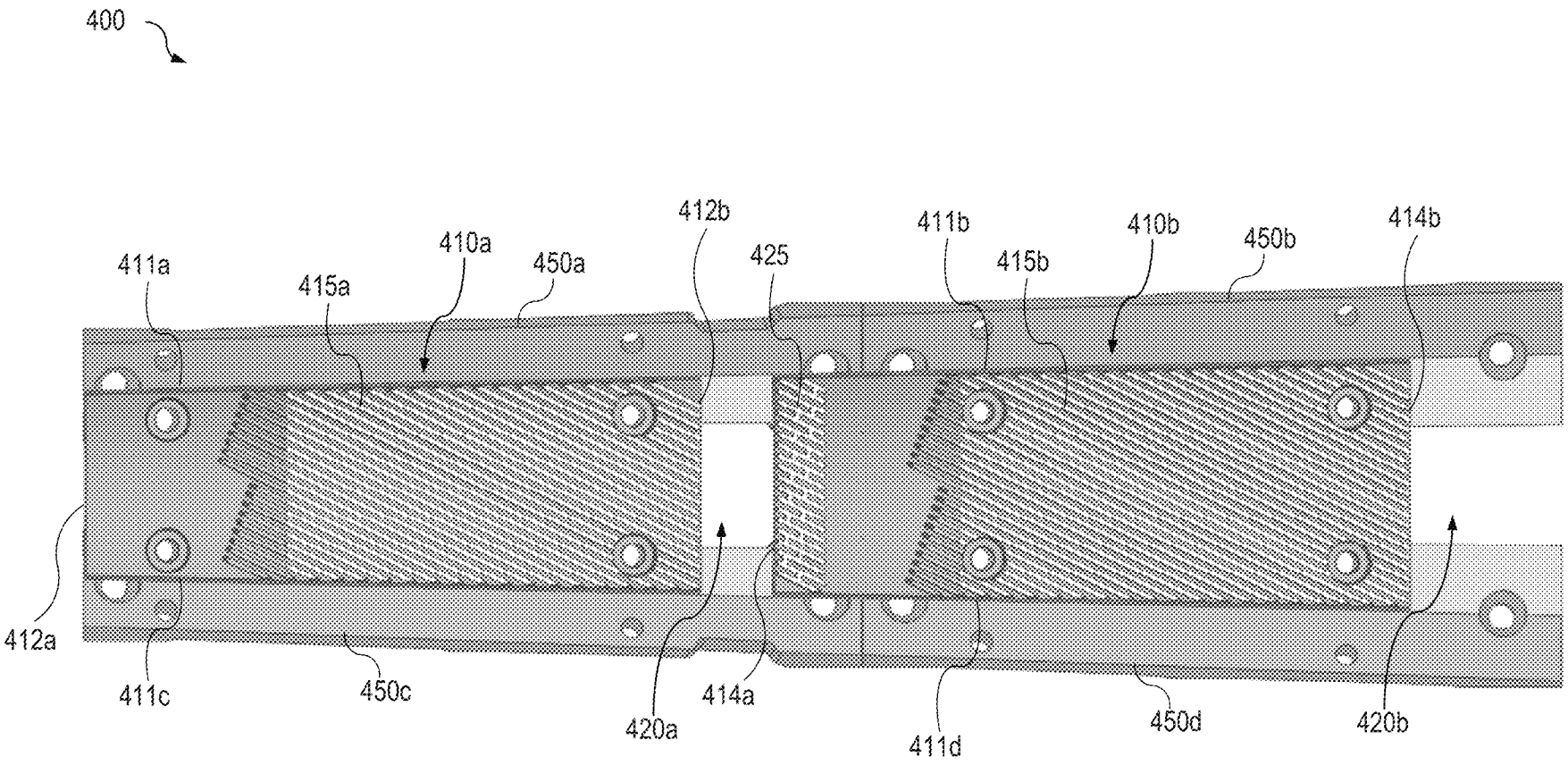
FIG. 4A is a diagram illustrating an example of a stator plate element according to some aspects of the present disclosure.
Figure 5:
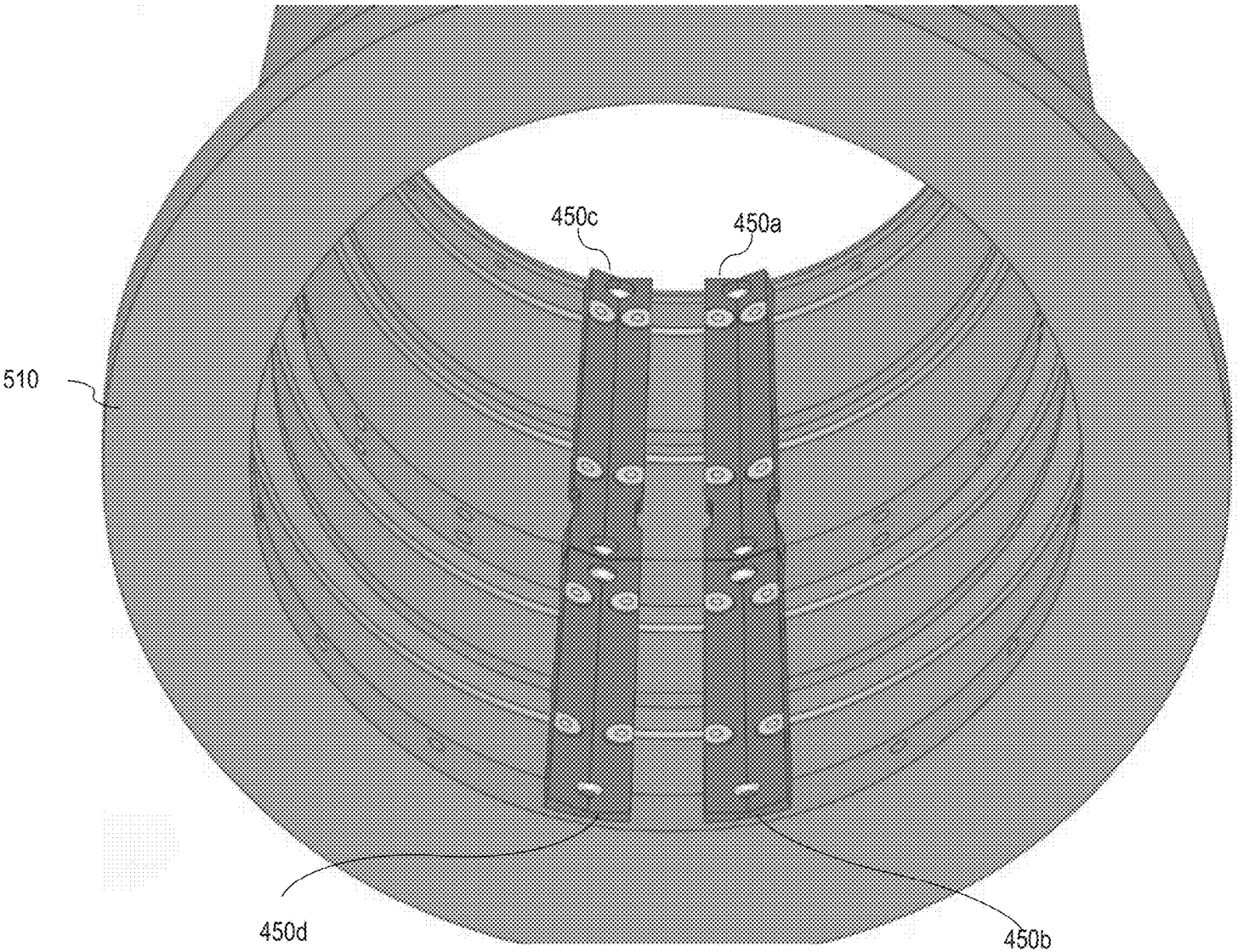
FIG. 5 is a diagram illustrating attaching rails mounted to a stator support frame according to some aspects of the present disclosure.

FIG. 4A is a diagram illustrating an example of a stator plate element 400 according to some aspects of the present disclosure. The stator plate element 400 may include stator plate segments 410*a*, 410*b* mounted on attaching rails 450*a*-450*d*. The attaching rails 450*a*, 450*b* may be coupled to first edge portions 411*a*, 411*b* of the stator plate segments 410*a*, 410*b*, respectively. The attaching rails 450*c*, 450*d* may be coupled to second edge portions 411*c*, 411*d* of the stator plate segments 410*a*, 410*b*, respectively. The first edge portions 411*a*, 411*b* of the stator plate segments 410*a*, 410*b* may be disposed opposite the second edge portions 411*c*, 411*d*. The stator plate element 400 may be mounted to a conical stator support frame via the attaching rails 450*a*-450*d*. FIG. 5 is a diagram illustrating attaching rails mounted to a stator support frame according to some aspects of the present disclosure. As shown in FIG. 5, the attaching rails 450*a*-450*d* may be mounted to the conical stator support frame 510. Stator plate segments (e.g., the stator plate segments 410*a*, 410*b*) may be attached to the attaching rails 450*a*-450*d* using appropriate fasteners. While only one set of attaching rails 450*a*-450*d* is illustrated in FIG. 5, a plurality of set of attaching rails may be disposed around the conical stator support frame 510. Further, while the attaching rails 450*a*, 450*b* and 450*c*, 450*d* are illustrated as two piece rails, in some implementations the attaching rail 450*a*, 450*b* may be formed as a single piece and the attaching rail 450*c*, 450*d* may be formed as a single piece.

A plurality of stator plate elements 400 may be disposed around a conical stator support frame to form the conical-shaped stator 110 illustrated in FIG. 1. Returning to FIG. 4A, the stator plate element 400 may be arranged in a longitudinal direction with respect to an axis of rotation "R" of the conical rotor 120 illustrated in FIG. 1. A first end 412*a* of the stator plate segment 410*a* may be disposed on the attaching rails 450*a*, 450*c* mounted on the conical stator support frame toward a smaller end of the cone. A second end 412*b* of the stator plate segment 410*a* may be disposed on the attaching rails 450*a*, 450*c* facing a first end 414*a* of the stator plate segment 410*b*. The first end 414*a* of the stator plate segment 410*b* may be disposed on the attaching rails 450*b*, 450*d* at an intermediate point on the conical stator support frame. A second end 414*b* of the stator plate segment 410*b* may be disposed on the attaching rails 450*b*, 450*d* on the conical stator support frame towards a larger end of the cone.

Each stator plate segment 410*a*, 410*b* may include one or more stator refining areas 415*a*, 415*b*. The stator refining areas 415*a*, 415*b* may include patterns of bars and grooves and/or other features configured to refine the feedstock. Outlet openings 420*a*, 420*b* may be formed according to the positions in which the stator plate segments 410*a*, 410*b* are mounted on the attaching rails 450*a*-450*d*. In some implementations, the stator plate segments 410*a*, 410*b* may be mounted on the attaching rails 450*a*-450*d* such that the outlet openings are formed between the stator plate segments 410*a*, 410*b* and at the second end 414*b* of the stator plate segment 410*b* as illustrated in FIG. 4A. In some implementations, the stator plate segments 410*a*, 410*b* may be mounted on the attaching rails 450*a*-450*d* such that the outlet openings are formed at opposite ends of the stator plate segments. For example, the stator plate segment 410*a* may be mounted on the attaching rails 450*a*, 450*b* such that the second end 412*b* of the stator plate segment 410*a* abuts the first end 414*a* of the stator plate segment 410*b*, thereby providing outlet openings adjacent to the first end 412*a* of the stator plate segment 410*a* and adjacent to the second end 414*b* of the stator plate segment 410*b*.

In some implementations, the stator plate segment 410*b* may include a blocking portion 425 disposed at the first end 414*a* of the stator plate segment 410*b*. The blocking portion 425 may be configured to prevent feedstock that enters from inlet openings of the rotor from exiting through the outlet opening 420*a* without passing through the refining area 415*b* of the stator plate segment 410*b*.

Figure 4B:
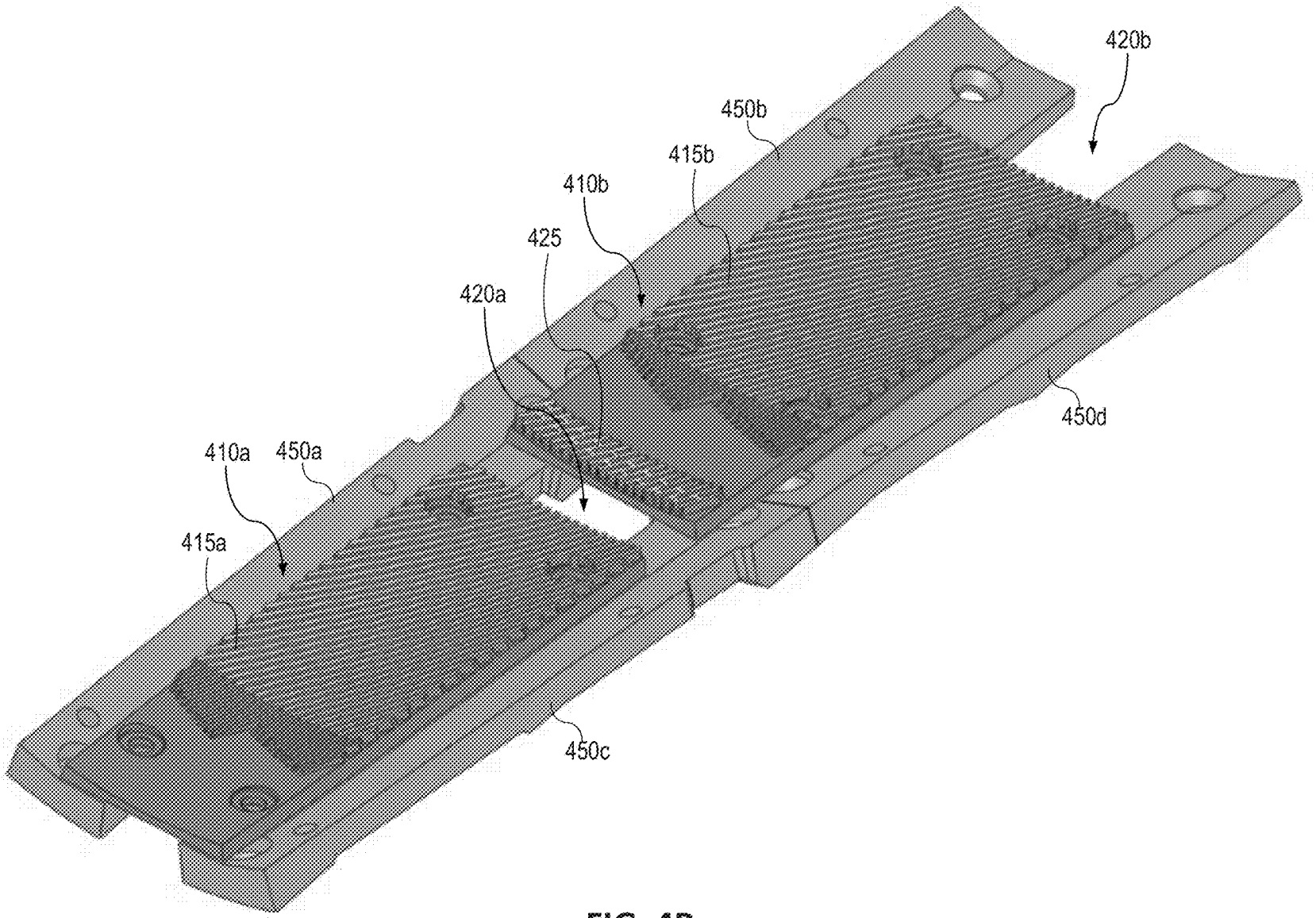
FIG. 4B is a perspective view of the stator plate element of FIG. 4A according to some aspects of the present disclosure.

FIG. 4B is a perspective view of the stator plate element 400 of FIG. 4A according to some aspects of the present disclosure. The stator plate segments 410*a*, 410*b* may have a thickness less than the thickness of the rotor plate segments to account for the thickness of the attaching rails 450*a*-450*d* on which the stator plate segments 410*a*, 410*b* are mounted.

Figure 6A:
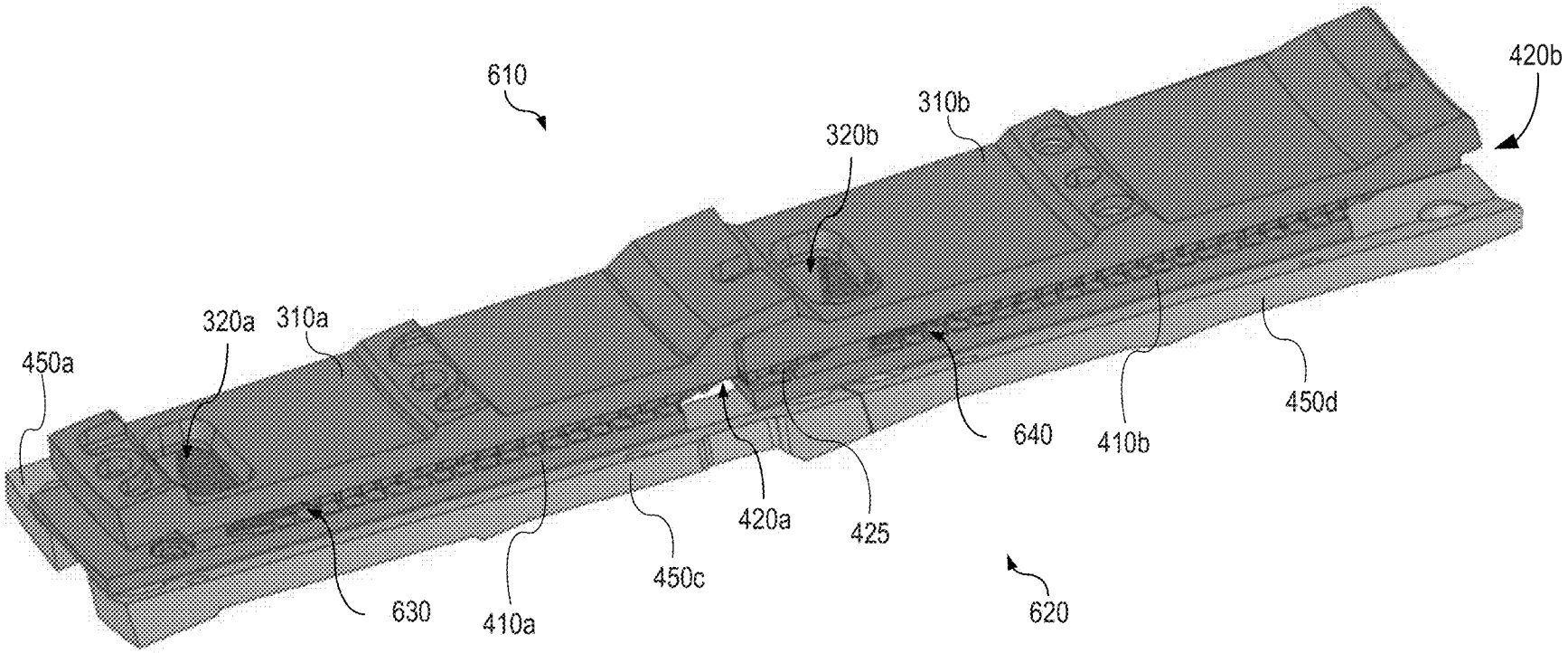
FIG. 6A is a top perspective view of corresponding stator and rotor plate elements according to some aspects of the present disclosure.

FIG. 6A is a top perspective view of corresponding stator and rotor plate elements according to some aspects of the present disclosure. FIG. 6A illustrates a relative position of a rotor plate element 610 and a stator plate element 620 as they would appear when installed in a conical refiner. Referring to FIG. 6A, a rotor plate element 610 may include rotor plate segments 310*a*, 310*b* having refining areas 315*a*, 315*b* as illustrated in FIG. 3A. The rotor plate segments 310*a*, 310*b* may be mounted to a conical rotor support frame (not shown). The stator plate element 620 may include stator plate segments 410*a*, 410*b* and attaching rails 450*a*-450*d* of which only attaching rails 450*a*, 450*c*, and 450*d* are visible. The attaching rails 450*a*-450*d* may be mounted to a conical stator support frame (see FIG. 5). The stator plate segments 410*a*, 410*b* may include refining areas 415*a*, 415*b* as illustrated in FIG. 4A.

The rotor plate segment 310*a* may include an inlet opening 320*a* through which feedstock can be fed into a refining zone 630 formed between refining area 315*a* of the rotor plate segment 310*a* and the refining area 415*a* of the stator plate segment 410*a*. After passing through the refining zone 630, the refined feedstock may exit the conical refiner through an outlet opening 420*a* formed by a space between the attaching rails in an area between the longitudinally adjacent stator plate segments 410*a*, 410*b*. Similarly, the rotor plate segment 310*b* may include an inlet opening 320*b* through which feedstock can be fed into a refining zone 640 formed between refining area 315*b* of the rotor plate segment 310*b* and the refining area 415*b* of the stator plate segment 410*b*. After passing through the refining zone 640, the refined feedstock may exit the conical refiner through an outlet opening 420*b* formed by a space between the attaching rails in an area at a second end 414*b* of the stator plate segment 410*b*. The outlet opening 420*b* at the second end of the stator plate segment 410*b* formed by the space between the attaching rails is obscured by the rotor plate segment 310*b* in FIG. 6A. The feedstock inlet openings and feedstock outlet openings may be offset from each other in an axial direction with respect to the direction of rotation of the rotor in order to promote feedstock flow from the feedstock inlet openings, through the refining zones, and then out of the feedstock outlet openings. In some implementations, the stator plate segment 410*b* may include a blocking portion 425 to inhibit feedstock entering through inlet opening 320*b* in rotor plate segment 310*b* from passing directly out of outlet opening 420*a* without passing through the refining zone 640.

Figure 6B:
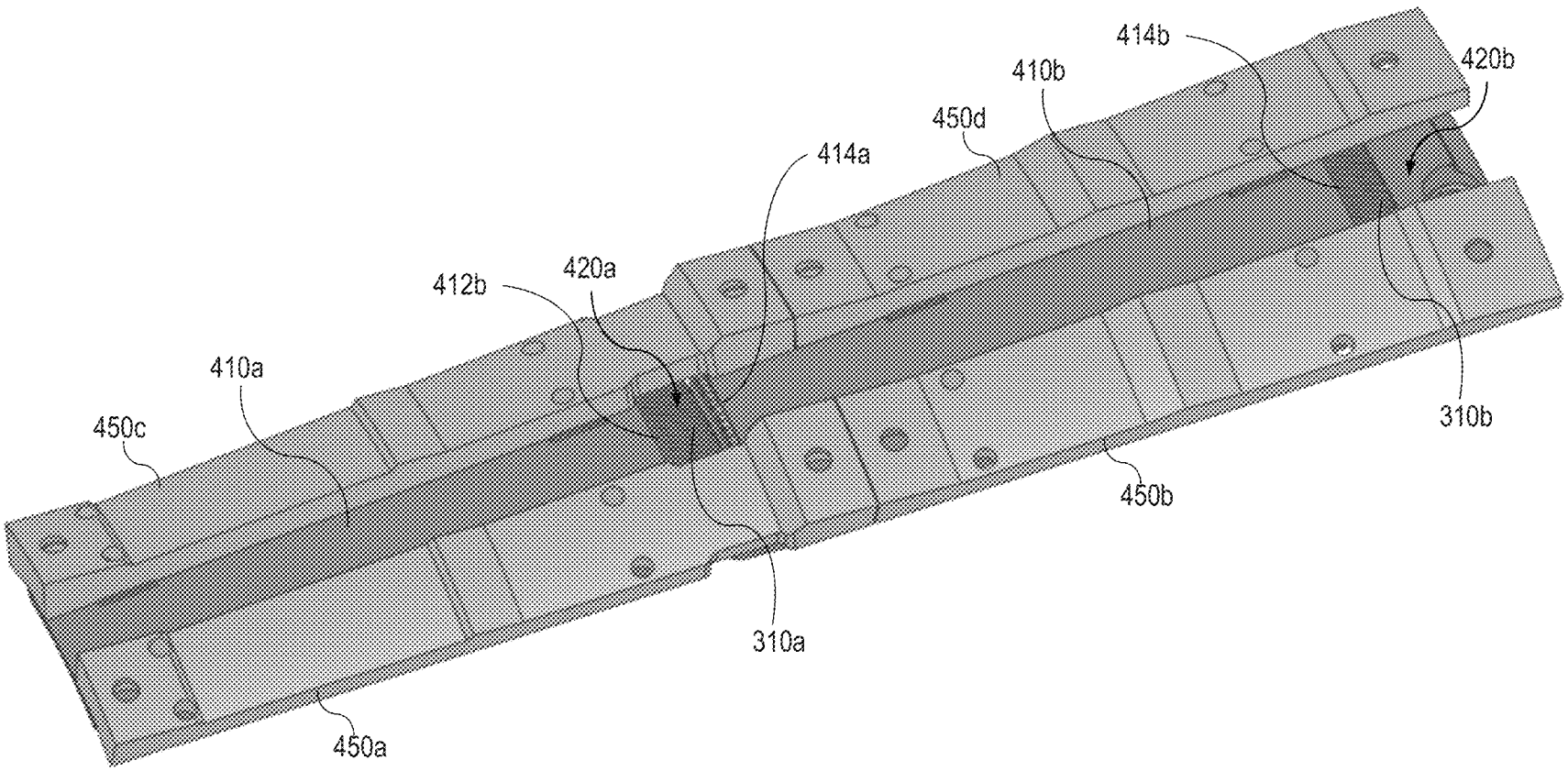
FIG. 6B is a bottom perspective view of the corresponding stator and rotor plate elements illustrated in FIG. 6A according to some aspects of the present disclosure.

FIG. 6B is a bottom perspective view of the corresponding stator and rotor plate elements illustrated in FIG. 6A according to some aspects of the present disclosure. Referring to FIG. 6B, the stator plate segment 410*a* may be attached to attaching rails 450*a*, 450*c*. The stator plate segment 410*b* may be attached to attaching rails 450*b*, 450*d*. An outlet opening 420*a* may be formed by the separation between the attaching rails 450*a*, 450*c* in the area between the second end 412*b* of the stator plate segment 410*a* and the first end 414*a* of the stator plate segment 410*b*. A portion of the rotor plate segment 310*a* can be seen through the outlet opening 420*a*. Another outlet opening 420*b* may be formed by the separation between the attaching rails 450*b*, 450*d* in the area at the second end 414*b* of the stator plate segment 410*b*. A portion of the rotor plate segment 310*b* can be seen through the outlet opening 420*b*.

Figure 7:
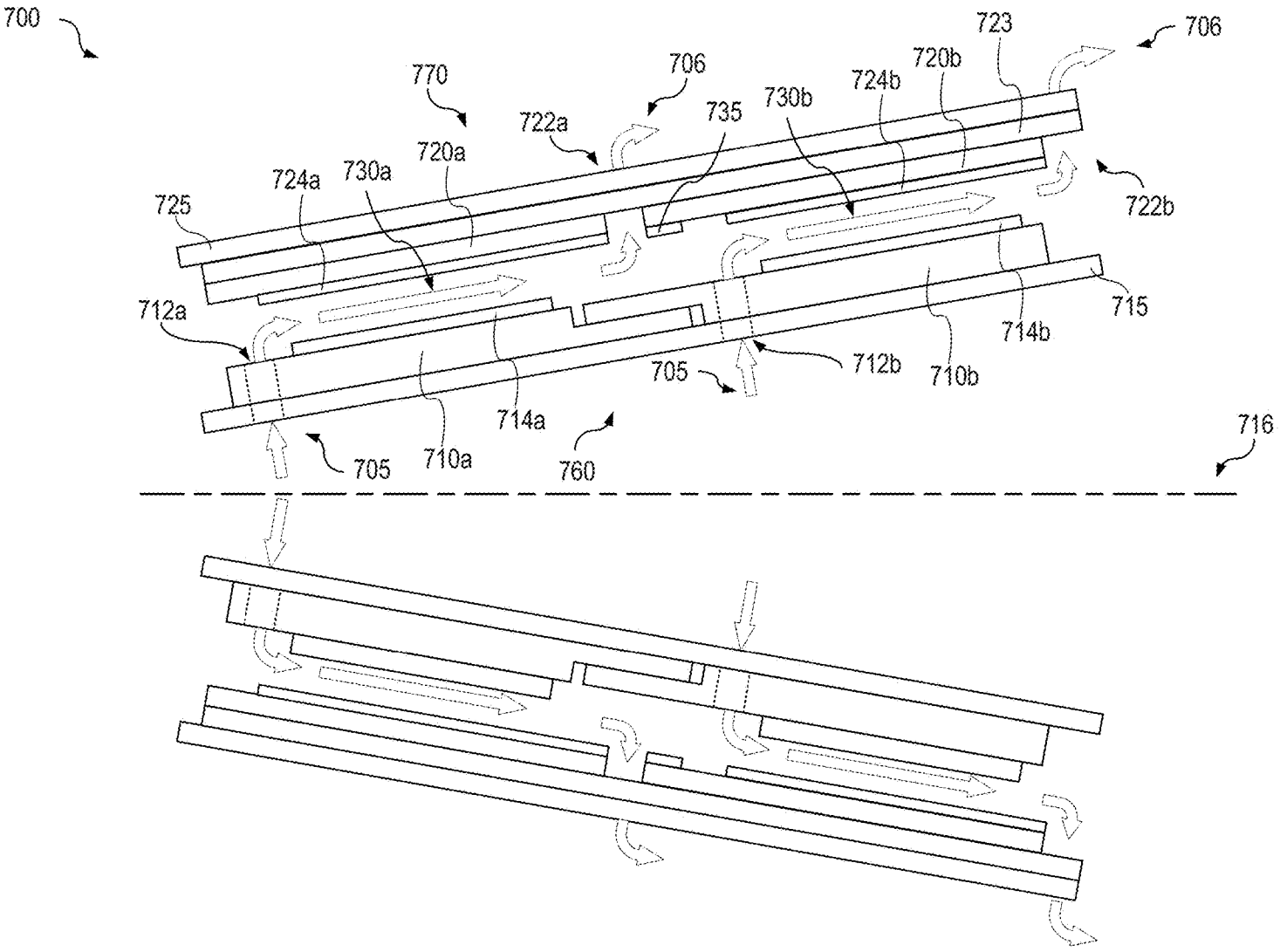
FIG. 7 is a diagram illustrating a simplified example of feedstock flow through refining zones of a conical refiner having the exemplary rotor plate segments and stator plate segments according to some aspects of the present disclosure.

FIG. 7 is a diagram illustrating a simplified example of feedstock flow 705 through refining zones 730*a*, 730*b* of a conical refiner 700 having the exemplary rotor plate segments 710*a*, 710*b* and stator plate segments 720*a*, 720*b* according to some aspects of the present disclosure. As used herein, a "refining zone" 730*a*, 730*b* can be defined as the refining areas of a rotor plate segment and a stator plate segment forming a refining gap. The rotor plate segments 710*a*, 710*b* may be the rotor plate segments 310*a*, 310*b* illustrated in FIG. 3. The stator plate segments 720*a*, 720*b* may be the stator plate segments 410*a*, 410*b* illustrated in FIG. 4. The stator plate segments 720*a*, 720*b* may be coupled to attaching rails 723. The attaching rails 723 may be the attaching rails 450*a*-450*d* illustrated in FIG. 4. The combination of rotor plate segments 710*a*, 710*b* may be referred to herein as a rotor plate element 760, and the combination of stator plate segments 720*a*, 720*b* and attaching rails 723 may be referred to herein as a stator plate element 770. While FIG. 7 illustrates two rotor plate segments 710*a*, 710*b* forming the rotor plate element 760, a rotor plate element may be formed by one, two, or more than two rotor plate segments. Similarly, a stator plate element may be formed by one, two, or more than two stator plate segments.

The rotor plate segments 710*a*, 710*b* may include inlet openings 712*a*, 712*b*, and rotor plate segment refining areas 714*a*, 714*b*. In some implementation, the inlet openings 712*a*, 712*b* may not extend into the rotor plate segment refining areas 714*a*, 714*b*. In some implementations, the inlet openings 712*a*, 712*b* may extend partially or completely into the rotor plate segment refining areas 714*a*, 714*b*. The rotor plate segments 710*a*, 710*b* may be coupled to a conical rotor support frame 715. Multiple rotor plate segments may be coupled around the conical rotor support frame 715 forming a conical shape. The conical rotor support frame 715 and the rotor plate segments may rotate around an axis 716 driven by a motor (not shown).

The stator plate segments 720*a*, 720*b* may include stator plate segment refining areas 724*a*, 724*b*. The stator plate segments 720*a*, 720*b* may be coupled to the attaching rails 723, and the attaching rails 723 coupled to a conical stator support frame 725. Outlet openings 722*a*, 722*b* may be formed by the separation between the attaching rails at ends of the stator plate segments 720*a*, 720*b* as can be seen, for example, as outlet openings 420*a* and 420*b* in FIGS. 4B and 6B. In some implementations, at least one of the stator plate segments 720*a*, 720*b* may include a blocking portion 735 configured to inhibit feedstock entering through an inlet opening in a rotor plate segment from passing directly out of an outlet opening without passing through a refining zone. For example, referring to FIG. 7, the blocking portion 735 may inhibit feedstock entering through inlet opening 712*b* from passing directly out of outlet opening 722*a* without passing through the refining zone 730*b*.

Multiple stator plate segments may be coupled around the conical stator support frame 725 forming a conical shape disposed around the conical shape formed by the rotor plate segments. In some implementations, the conical stator support frame 725 and stator plate segments may be stationary. In some implementations, the conical stator support frame 725 and stator plate segments may rotate around the axis 716 in a direction opposite the direction of rotation of the conical rotor support frame 715 and the rotor plate segments.

In some implementations, each rotor plate segment and stator plate segment may form multiple refining zones. For each refining zone, one or more feedstock inlet openings in the rotor plate segment may be disposed at one end of the rotor plate segment refining area, and one or more feedstock outlet openings in the stator plate segment may be disposed at an opposite end of the stator plate segment refining area. In some implementations, the rotor plate segments and stator plate segments may form a single refining zone having one inlet and one outlet. For example, referring to FIG. 7, for each pair of rotor plate segments 710*a*, 710*b* (e.g., rotor plate element 760), only one inlet opening 712*a* may be provided, and only one outlet opening 722*b* may be provided for the corresponding pair of stator plate segments 720*a*, 720*b* (e.g., stator plate element 770).

In some implementations, the refining zones may not span the entire length of the rotor and stator plate segments. For example, rotor plate segments 710*a*, 710*b* may each include two refining areas (e.g., each refining area 714*a*, 714*b* may be split to form two refining areas for each segment) with inlet openings 712*a*, 712*b* plus additional inlet openings in the middle of the segments between the refining areas. The corresponding stator plate elements may then include four stator plate segments having outlet openings formed by the separation between the attaching rails with the outlet openings being disposed between adjacent stator plate segments and/or disposed adjacent to the ends of the stator plate segments.

The area between the inlet openings and the outlet openings of a refining zone is substantially covered by a pattern of bars and grooves. Typically, the refining areas of the rotor plate segments and the stator plate segments are covered by a relatively continuous design of bars and grooves that run substantially parallel in configurations that may be straight, curved, bent, or a combination of the configurations. Each refining areas of the rotor plate segments and stator plate segments can be continuous with a constant design of bars and grooves, can be separated in sections, can have different patterns of bars and grooves, such as a coarser zone and a finer zone, and/or can have different bar heights, different bar angles, etc.

As shown in FIG. 7, pressurized feedstock 705 may be conducted through the inlet openings 712*a*, 712*b* in the rotor. The feed stock pressure, the effect of angles on the rotor bars and/or centrifugal force produced by the rotating rotor plate elements 760 may cause the feedstock 705 to pass through the refining zones 730*a*, 730*b* formed between the rotor plate segment refining areas 714*a*, 714*b* and the stator plate segment refining areas 724*a*, 724*b* where the feedstock 705 is refined.

The combined feeding forces may cause the refined feedstock 706 to be conducted out of the conical refiner via the outlet openings 722*a*, 722*b* between the stator plate segments 720*a*, 720*b* and adjacent to the end of the stator plate segment 720*b*. Thus, the positioning of the inlet openings 712*a*, 712*b* and the outlet openings 722*a*, 722*b* at opposite ends of the refining zones 730*a*, 730*b* causes the feedstock entering the conical refiner to pass through the refining zones 730*a*, 730*b* before exiting the conical refiner, thereby ensuring that feedstock is unlikely to pass through the conical refiner without treatment.

The inlet opening locations for each refining zone may be defined on the rotor plate segments and may be at a defined location along the length of the rotor plate segments. In some implementations, the conical-shaped rotor may have the same number of inlet openings as the number of rotor plate segments (e.g., one inlet opening per rotor plate segment). In some implementations, each rotor plate segment may have multiple inlet openings. In some implementations, less than all of the rotor plate segments may have one or more inlet openings. The size and number of the inlet openings that create an inlet location may depend on the required feedstock flow that needs to pass through the defined refining zone that will be fed by that inlet location.

The outlet opening locations for each refining zone may be defined with respect to the positions of the stator plate segments. The refined feedstock may flow through the outlet openings formed between the attaching rails between the stator plate segments or adjacent to the ends of the stator plate segments. In some implementations, the refined feedstock may flow through the outlet openings formed by the attaching rails at opposite ends of stator plate segments. The outlet opening locations may be offset relative to the rotor inlet openings by at least a distance across a refining zone. Thus, as the feedstock enters through the inlet openings in the rotor plate segment, the feedstock will travel some distance along the refining gap created between the rotor refining area and the stator refining area (e.g., the refining zone) before it reaches the outlet openings.

The distance between the inlet openings and outlet openings along the refining gap may be, for example, 50 mm, 300 mm or another distance. In some implementations, multiple refining zones may be disposed along the length of a gap between the rotor and stator plate segments, and each refining zone may have its own inlet and outlet location with the rotor and stator refining areas spanning between them.

Figure 8:
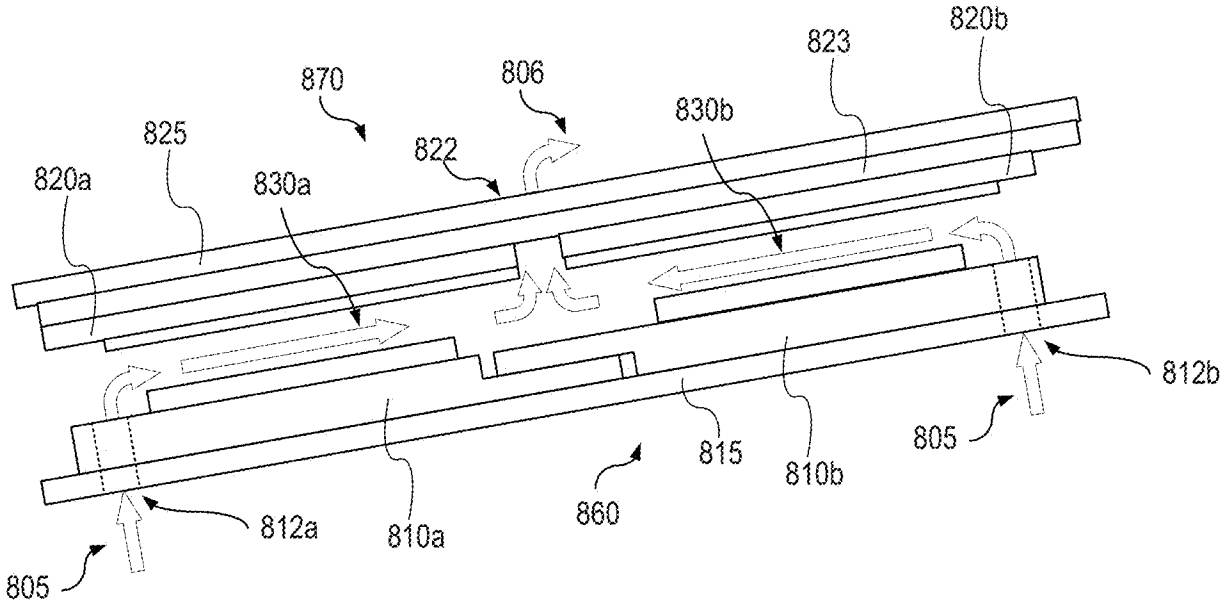
FIG. 8 is a simplified diagram illustrating feedstock flow for examples of rotor and stator plate elements having a common outlet opening according to some aspects of the present disclosure.

In some implementations, two or more refining zones may have a common outlet opening or inlet opening, for example, at a mid-point between two rotor plate segments or two stator plate segments, when the feedstock flow travel towards or away from each segment, respectively. FIG. 8 is a simplified diagram illustrating feedstock flow for examples of rotor and stator plate elements having a common outlet opening according to some aspects of the present disclosure. Referring to FIG. 8, the rotor plate element 860 may include rotor plate segments 810*a*, 810*b*. The rotor plate element 860 may be coupled to the conical rotor support frame 815. The stator plate element 870 may include stator plate segments 820*a*, 820*b* and attaching rails 823. The stator plate segments 820*a*, 820*b* may be coupled to attaching rails 823 and the attaching rails 823 may be coupled to the conical stator support frame 825.

Inlet openings 812*a*, 812*b* may be disposed at locations at opposite ends of the rotor plate element 810 in each of rotor plate segments 810*a*, 810*b*. Outlet openings 822*a* may be disposed at a location at an intermediate point between the stator plate segments 820*a*, 820*b*. As illustrated in FIG. 8A, the feedstock 805 may be conducted into the inlet opening 812*a* and travel through the refining zone 830*a* toward the mid-point between the rotor plate segments 810*a*, 810*b* and the stator plate segments 820*a*, 820*b*. Concurrently, feedstock 805 may be conducted into the inlet opening 812*b* at the opposite end of the rotor plate element 810 and travel in an opposite direction through the refining zone 830*b* toward the mid-point between the rotor plate segments 810*a*, 810*b* and the stator plate segments 820*a*, 820*b*. Refined feedstock 806 from refining zones 830*a*, 830*b* may exit the conical refiner via the common outlet opening 822 between the stator plate segments 820*a*, 820*b*. The common outlet opening 822 may be formed by the separation between the attaching rails 823 in the area between adjacent ends of the stator plate segments 820*a*, 820*b*.

Figure 9:
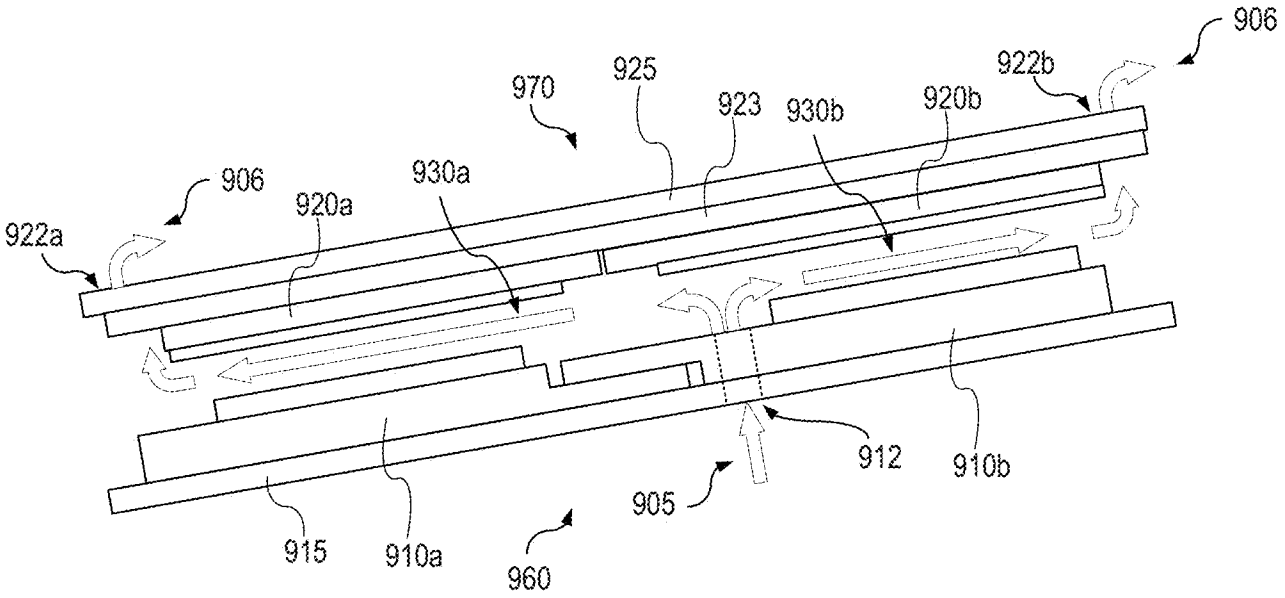
FIG. 9 is a simplified diagram illustrating feedstock flow for examples of rotor and stator elements having a common inlet opening according to some aspects of the present disclosure.

FIG. 9 is a simplified diagram illustrating feedstock flow for examples of rotor and stator elements having a common inlet opening according to some aspects of the present disclosure. Referring to FIG. 9, the rotor plate element 960 may include rotor plate segments 910*a*, 910*b*. The rotor plate element 960 may be coupled to the conical rotor support frame 915. The stator element 970 may include stator plate segments 920*a*, 920*b* and attaching rails 923. The stator plate segments 920*a*, 920*b* may be coupled to attaching rails 923 and the attaching rails 923 may be coupled to the conical stator support frame 925. The feedstock 905 may be conducted into the common inlet opening 912 disposed at a location at an intermediate point between the rotor plate segments 910*a*, 910*b*.

As illustrated in FIG. 9, the feedstock 905 may travel in one direction through the refining zone 930*a* toward an end of the rotor plate segment 910*a* and a corresponding end of the stator plate segment 920*a* through the refining zone 930*a*. Concurrently, the feedstock 905 may travel in an opposite direction through the refining zone 930*b* toward an end opposite of the rotor plate segment 910*b* and a corresponding end of the stator plate segment 920*b* through the refining zone 930*b*. Refined feedstock 906 from refining zones 930*a* may exit the conical refiner via outlet opening 922*a* in the stator plate segment 920*a* and refined feedstock 906 from refining zones 930*b* may exit the conical refiner via outlet opening 922*b* in the stator plate segment 920*b*.

In some implementations, feedstock may flow from the smaller end of the conical shape towards the larger end of the conical shape in all refining zones. In some implementations, the feedstock may flow from the larger end of the conical shape towards the smaller end of the conical shape in all refining zones. In some implementations, feedstock may flow from the smaller end of the conical shape towards the larger end of the conical shape in some refining zones, while feedstock may flow from the larger end of the conical shape towards the smaller end of the conical shape in other refining zones.

Figure 10:
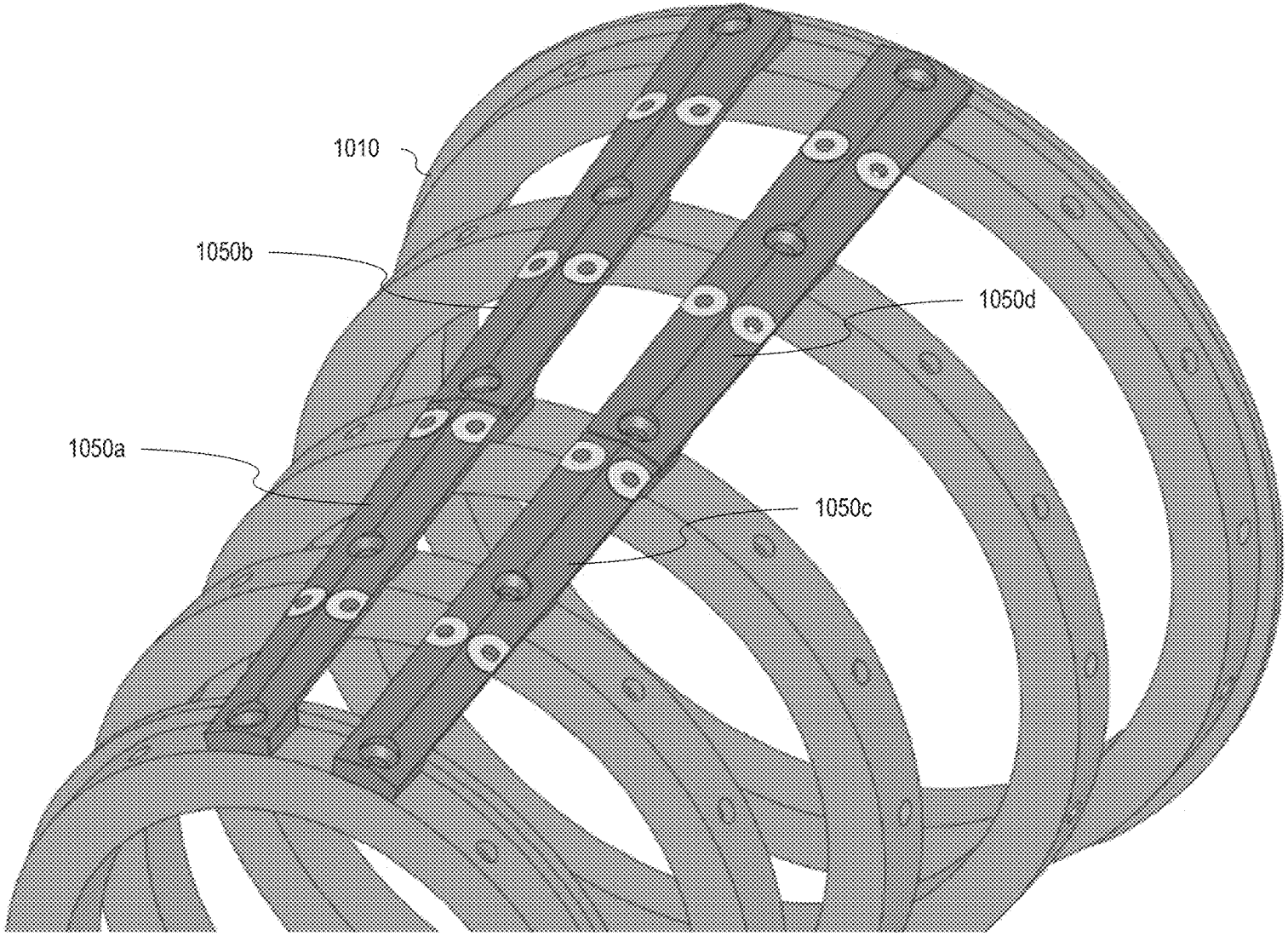
FIG. 10 is a perspective view illustrating attaching rails mounted on a conical rotor support frame according to some aspects of the present disclosure.

According to some aspects of the present disclosure, the rotor plate element may alternatively or additionally include attaching rails. FIG. 10 is a perspective view illustrating attaching rails 1050*a*-1050*d* mounted on a conical rotor support frame 1010 according to some aspects of the present disclosure. The attaching rails 1050*a*-1050*d* mounted on the conical rotor support frame 1010 with appropriate fasteners.

Figure 11:
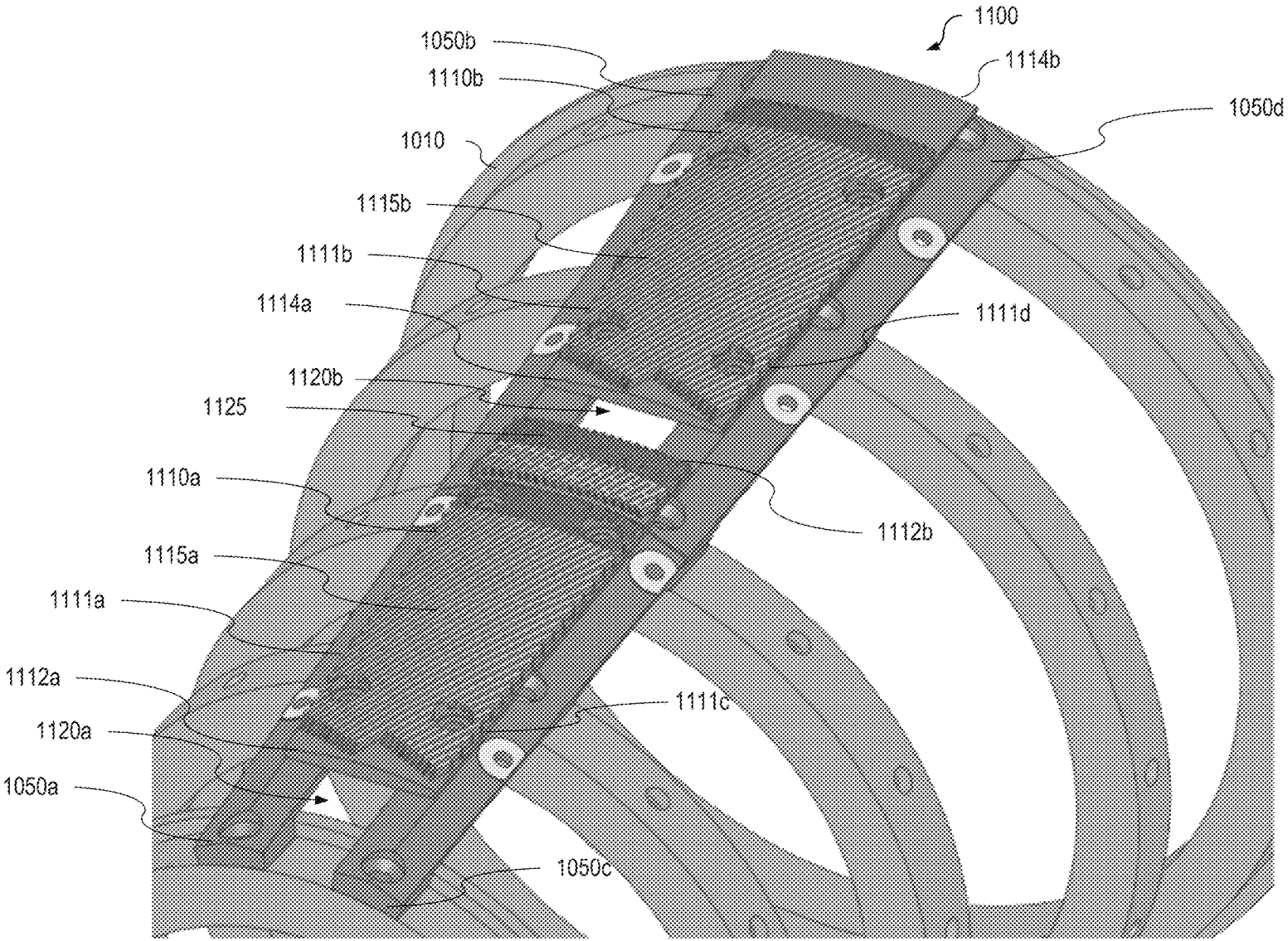
FIG. 11 is a perspective view of a rotor plate element according to some aspects of the present disclosure.

FIG. 11 is a perspective view of a rotor plate element 1100 according to some aspects of the present disclosure. The rotor plate element 1100 may include rotor plate segments 1110*a*, 1110*b* and attaching rails 1050*a*-1050*d*. The attaching rails 1050*a*-1050*b* may be coupled to first edge portions 1111*a*, 1111*b* of the rotor plate segments 1110*a*, 1110*b*, respectively. The attaching rails 1050*c*-1050*d* may be coupled to second edge portions 1111*c*, 1111*d* of the rotor plate segments 1110*a*, 1110*b*, respectively. The first edge portions 1111*a*, 1111*b* of the rotor plate segments 1110*a*, 1110*b* may be disposed opposite the second edge portions 1111*c*, 1111*d*. The rotor plate element 1100 may be mounted to the conical rotor support frame 1010 via the attaching rails 1050*a*-1050*d*. The rotor plate segments may be attached to the attaching rails 450*a*-450*d* using appropriate fasteners. The rotor plate segments 1110*a*, 1110*b* may have a thickness less than the thickness of rotor plate segments used without attaching rails to account for the thickness of the attaching rails 1050*a*-1050*d* on which the rotor plate segments 1110*a*, 1110*b* are mounted. While only one set of attaching rails 1050*a*-1050*d* is illustrated in FIG. 11, a plurality of sets of attaching rails may be disposed around the conical rotor support frame 1010. Further, while the attaching rails 1050*a*, 1050*c* and 1050*b*, 1050*d* are illustrated as two piece rails, in some implementations the attaching rail 1050*a*, 1050*c* may be formed as a single piece and the attaching rail 1050*a*, 1050*c* may be formed as a single piece.

A plurality of rotor plate elements 1100 may be disposed around a conical rotor support frame to form the conical rotor 110 illustrated in FIG. 1. Returning to FIG. 11, the rotor plate element 1100 may be arranged in a longitudinal direction with respect to an axis of rotation "R" of the conical rotor 110 illustrated in FIG. 1. A first end 1112*a* of the rotor plate segment 1110*a* may be disposed on the attaching rails 1150*a*, 1150*c* mounted on the conical rotor support frame toward a smaller end of the cone. A second end 1112*b* of the rotor plate segment 1110*a* may be disposed on the attaching rails 1150*a*, 1150*c* facing a first end 1114*a* of the rotor plate segment 1110*b*. The first end 1114*a* of the rotor plate segment 1110*b* may be disposed on the attaching rails 1150*b*, 1150*d* at an intermediate point on the conical rotor support frame. A second end 1114*b* of the stator plate segment 1110*b* may be disposed on the attaching rails 1150*b*, 1150*d* on the conical stator support frame towards a larger end of the cone.

Each rotor plate segment 1110*a*, 1110*b* may include one or more rotor refining areas 1115*a*, 1115*b*. The rotor refining areas 1115*a*, 1115*b* may include patterns of bars and grooves and/or other features configured to refine the feedstock. Inlet openings 1120*a*, 1120*b* may be formed according to the positions in which the rotor plate segments 1110*a*, 1110*b* are mounted on the attaching rails 1050*a*-1050*d*. In some implementations, the rotor plate segments 1110*a*, 1110*b* may be mounted on the attaching rails 1050*a*-1050*d* such that the inlet openings 1120*a*, 1120*b* are formed between the rotor plate segments 1110*a*, 1110*b* and adjacent to the first end 1112*a* of the rotor plate segment 1110*a* as illustrated in FIG. 11. In some implementations, the rotor plate segments 1110*a*, 1110*b* may be mounted on the attaching rails 1050*a*-1050*d* such that the inlet openings are formed at opposite ends of the rotor plate segments. For example, the rotor plate segment 1110*b* may be mounted on the attaching rails 1050*a*-1050*d* such that the second end 1112*b* of the rotor plate segment 1110*a* abuts the first end 1114*a* of the rotor plate segment 1110*b*, thereby providing inlet openings adjacent to the first end 1112*a* of the rotor plate segment 1110*a* and adjacent to the second end 1114*b* of the rotor plate segment 1110*b*.

The inlet opening 1120*a* may be formed by a space between the attaching rails 1050*a*-1050*c* in an area adjacent to a first end 1112*a* of the rotor plate segment 1110*a*. The inlet opening 1120*b* may be formed by a space between the attaching rails in an area between the rotor plate segments 1110*a*, 1110*b*. In some implementations, the rotor plate segment 1110*b* may include a blocking portion 1125 disposed at the first end 1114*a* of the rotor plate segment 1110*b*. The blocking portion 1125 may be configured to prevent feedstock that enters from inlet opening 1120*b* of the rotor from exiting through the outlet opening without passing through the refining area 1115*b* of the rotor plate segment 1110*b*.

Figure 12:
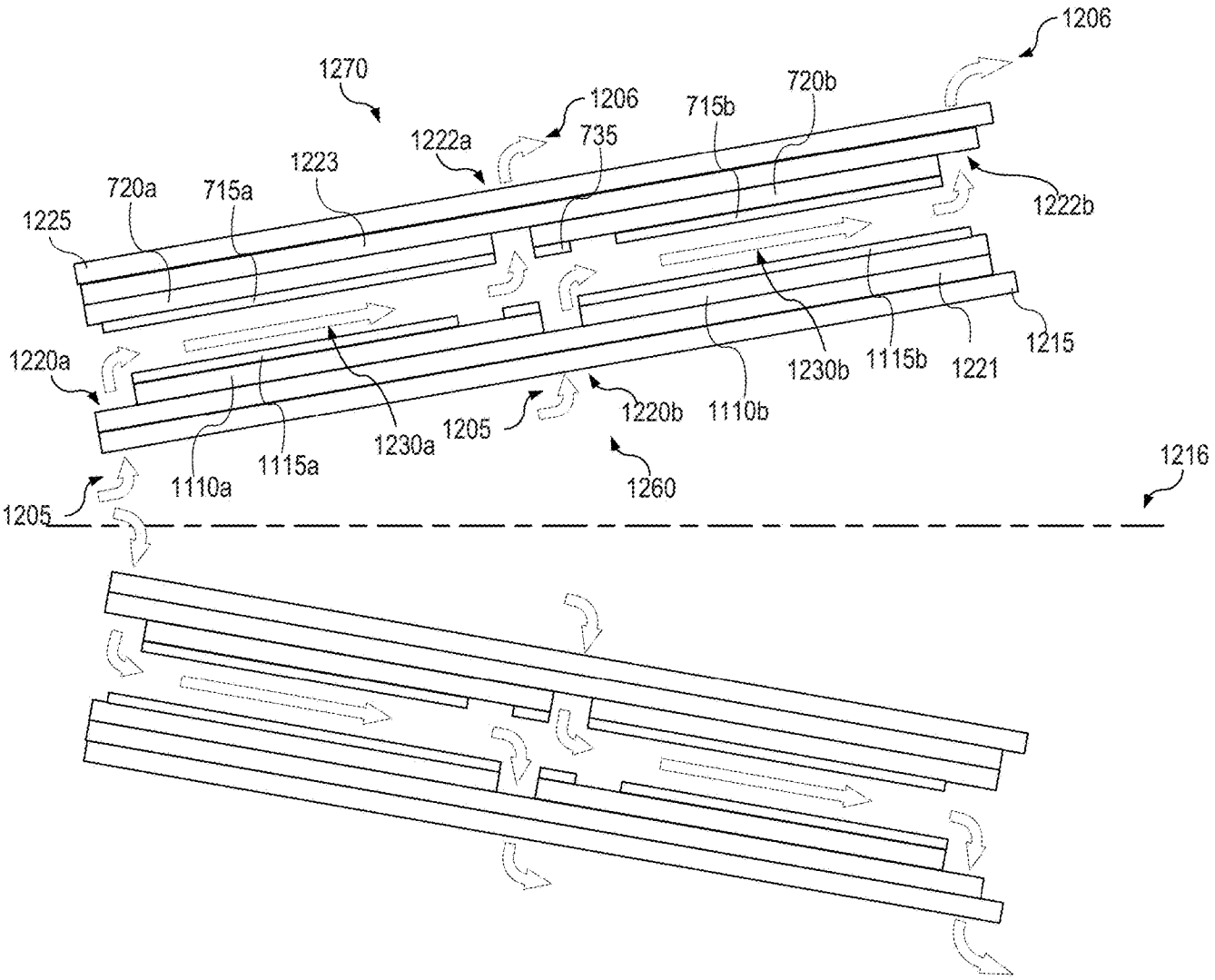
FIG. 12 is a diagram illustrating a simplified example of feedstock flow through refining zones of a conical refiner 1200 having the exemplary rotor plate segments and stator plate segments according to some aspects of the present disclosure.

FIG. 12 is a diagram illustrating a simplified example of feedstock flow 1205 through refining zones 1230*a*, 1230*b* of a conical refiner 1200 having the exemplary rotor plate segments 1110*a*, 1110*b* and stator plate segments 720*a*, 720*b* according to some aspects of the present disclosure. As used herein, a "refining zone" 1230*a*, 1230*b* can be defined as the refining areas of a rotor plate segment and a stator plate segment forming a refining gap. The rotor plate segments 1110*a*, 1110*b* may be coupled to attaching rails 1221. The attaching rails 1221 may be the attaching rails 1050*a*-1050*d* illustrated in FIG. 11. The stator plate segments 720*a*, 720*b* may be the stator plate segments 410*a*, 410*b* illustrated in FIG. 4. The stator plate segments 720*a*, 720*b* may be coupled to attaching rails 1223. The attaching rails 1223 may be the attaching rails 450*a*-450*d* illustrated in FIG. 4.

The combination of rotor plate segments 1110*a*, 1110*b* may be referred to herein as a rotor plate element 1260, and the combination of stator plate segments 720*a*, 720*b* and attaching rails 723 may be referred to herein as a stator element 1270. While FIG. 12 illustrates two rotor plate segments 1110*a*, 1110*b* forming the rotor plate element 1260, a rotor plate element may be formed by one, two, or more than two rotor plate segments. Similarly, a stator element may be formed by one, two, or more than two stator plate segments.

The rotor plate segments 1110*a*, 1110*b* may be attached to the attaching rails 1221, and the attaching rails 1221 may be coupled to a conical rotor support frame 1215. Multiple rotor plate segments may be coupled around the conical rotor support frame 1215 forming a conical shape. The conical rotor support frame 1215 and the rotor plate segments may rotate around an axis 1216 driven by a motor (not shown). The rotor plate segments 1110*a*, 1110*b* may be mounted on the attaching rails 1221 such that the inlet openings 1220*a*, 1220*b* are formed between the rotor plate segments 1110*a*, 1110*b* and adjacent to the first end of the rotor plate segment 1110*a* (see FIG. 11).

The stator plate segments 720*a*, 720*b* may include stator plate segment refining areas 715*a*, 715*b*. The stator plate segments 720*a*, 720*b* may be coupled to the attaching rails 1223, and the attaching rails 1223 may be coupled to a conical stator support frame 1225. Outlet openings 1222*a*, 1222*b* may be formed by the separation between the attaching rails at ends of the stator plate segments 720*a*, 720*b* as can be seen, for example, as outlet openings 420*a* and 420*b* in FIGS. 4B and 6B. In some implementations, at least one of the stator plate segments 720*a*, 720*b* may include a blocking portion 735 configured to inhibit feedstock entering through an inlet opening in a rotor plate segment from passing directly out of an outlet opening without passing through a refining zone. For example, referring to FIG. 12, the blocking portion 735 may inhibit feedstock entering through inlet opening 1220*b* from passing directly out of outlet opening 1222*a* without passing through the refining zone 1230*a*.

Multiple stator plate segments may be coupled around the conical stator support frame 1225 forming a conical shape disposed around the conical shape formed by the rotor plate segments. In some implementations, the conical stator support frame 1225 and stator plate segments may be stationary. In some implementations, the conical stator support frame 1225 and stator plate segments may rotate around the axis 1216 in a direction opposite the direction of rotation of the conical rotor support frame 1215 and the rotor plate segments.

In some implementations, each rotor plate segment and stator plate segment may form multiple refining zones. For each refining zone, one or more feedstock inlet openings may be formed by the separation between the attaching rails for the rotor plate segment and may be disposed adjacent to one end of the rotor plate segment, and one or more feedstock outlet openings may be formed by the separation between the attaching rails for the stator plate segment and may be disposed at an opposite end of the stator plate segment refining area. In some implementations, the rotor plate segments and stator plate segments may form a single refining zone having one inlet opening location and one outlet opening location. For example, referring to FIG. 11, for each pair of rotor plate segments 1110*a*, 1110*b* (e.g., rotor plate element 1260), only one inlet opening location may be provided, and only one outlet opening location may be provided for the corresponding pair of stator plate segments 720*a*, 720*b* (e.g., stator element 1270).

The area between the inlet openings and the outlet openings of a refining zone is substantially covered by a pattern of bars and grooves. Typically, the refining areas of the rotor plate segments and the stator plate segments are covered by a relatively continuous design of bars and grooves that run substantially parallel in configurations that may be straight, curved, bent, or a combination of the configurations. Each refining areas of the rotor plate segments and stator plate segments can be continuous with a constant design of bars and grooves, can be separated in sections, can have different patterns of bars and grooves, such as a coarser zone and a finer zone, and/or can have different bar heights, different bar angles, etc.

As shown in FIG. 12, pressurized feedstock 1205 may be conducted through the inlet openings 1220*a*, 1220*b* formed by the attaching rails 1221 in the rotor plate element 1260. The feed stock pressure, the effect of angles on the rotor bars and/or centrifugal force produced by the rotating rotor plate elements 1260 may cause the feedstock 1205 to pass through the refining zones 1230*a*, 1230*b* formed between the rotor plate segment refining areas 1115*a*, 1115*b* and the stator plate segment refining areas 715*a*, 715*b* where the feedstock 705 is refined.

The combined feeding forces may cause the refined feedstock 1206 to be conducted out of the conical refiner via the outlet openings 1222*a*, 1222*b* between the stator plate segments 720*a*, 720*b* and adjacent to the end of the stator plate segment 720*b*. Thus, the positioning of the inlet openings 1220*a*, 1220*b* and the outlet openings 1222*a*, 1222*b* at opposite ends of the refining zones 1230*a*, 1230*b* causes the feedstock entering the conical refiner to pass through the refining zones 1230*a*, 1230*b* before exiting the conical refiner, thereby ensuring that feedstock is unlikely to pass through the conical refiner without treatment.

The inlet opening locations for each refining zone may be defined according to positions of the rotor plate segments on the attaching rails. The raw feedstock may flow through the inlet openings formed between the attaching rails between or adjacent to the ends of the rotor plate segments. In some implementations, the raw feedstock may flow through the inlet openings formed by the attaching rails at opposite ends of rotor plate segments.

The outlet opening locations for each refining zone may be defined with respect to the positions of the stator plate segments on the attaching rails. The refined feedstock may flow through the outlet openings formed between the attaching rails between or adjacent to the ends of the stator plate segments. In some implementations, the refined feedstock may flow through the outlet openings formed by the attaching rails at opposite ends of stator plate segments. The outlet opening locations may be offset relative to the rotor inlet openings by at least a distance across a refining zone. Thus, as the feedstock enters through the inlet openings of the rotor plate element, the feedstock will travel some distance along the refining gap created between the rotor refining area and the stator refining area (e.g., the refining zone) before it reaches the outlet openings in the stator element.

The distance between the inlet openings and outlet openings along the refining gap may be, for example, 50 mm, 300 mm or another distance. In some implementations, multiple refining zones may be disposed along the length of a gap between the rotor and stator plate segments, and each refining zone may have its own inlet and outlet location with the rotor and stator refining areas spanning between them.

Figure 13:
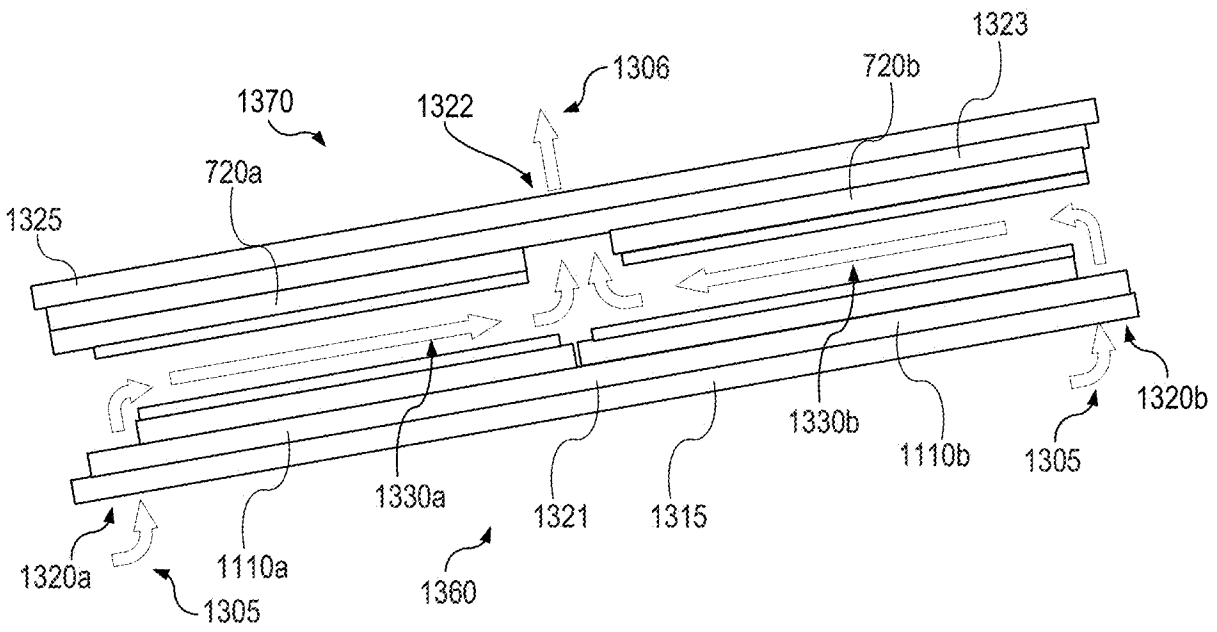
FIG. 13 is a simplified diagram illustrating feedstock flow for examples of rotor and stator elements having a common outlet opening according to some aspects of the present disclosure.

In some implementations, two or more refining zones may have a common outlet opening or inlet opening, for example, at a mid-point between two rotor plate segments or two stator plate segments, when the feedstock flow travel towards or away from each segment, respectively. FIG. 13 is a simplified diagram illustrating feedstock flow for examples of rotor and stator elements having a common outlet opening according to some aspects of the present disclosure. Referring to FIG. 13, the rotor plate element 1360 may include rotor plate segments 1110*a*, 1110*b* coupled to attaching rails 1321 and the attaching rails 1321 may be coupled to the conical rotor support frame 1315. The stator element 1370 may include stator plate segments 720*a*, 720*b* coupled to attaching rails 1323 and the attaching rails 1423 may be coupled to the conical stator support frame 1325.

Inlet openings 1320*a*, 1320*b* may be disposed at locations of the rotor plate element 1360 adjacent to opposite ends of rotor plate segments 1110*a*, 1110*b*. Outlet openings 1322*a* may be disposed at a location at an intermediate point between the stator plate segments 720*a*, 720*b*. As illustrated in FIG. 13, the feedstock 1305 may be conducted into the inlet opening 1320*a* and travel through the refining zone 1330*a* toward the mid-point between the rotor plate segments 1110*a*, 1110*b* and the stator plate segments 720*a*, 720*b*. Concurrently, feedstock 1305 may be conducted into the inlet opening 1320*b* at the opposite end of the rotor plate element 1360 and travel in an opposite direction through the refining zone 1330*b* toward the mid-point between the rotor plate segments 1110*a*, 1110*b* and the stator plate segments 720*a*, 720*b*. Refined feedstock 1306 from refining zones 1330*a*, 1330*b* may exit the conical refiner via the common outlet opening 1322 between the stator plate segments 720*a*, 720*b*. The common outlet opening 1322 may be formed by the separation between the attaching rails 723 in the area between adjacent ends of the stator plate segments 720*a*, 720*b*.

Figure 14:
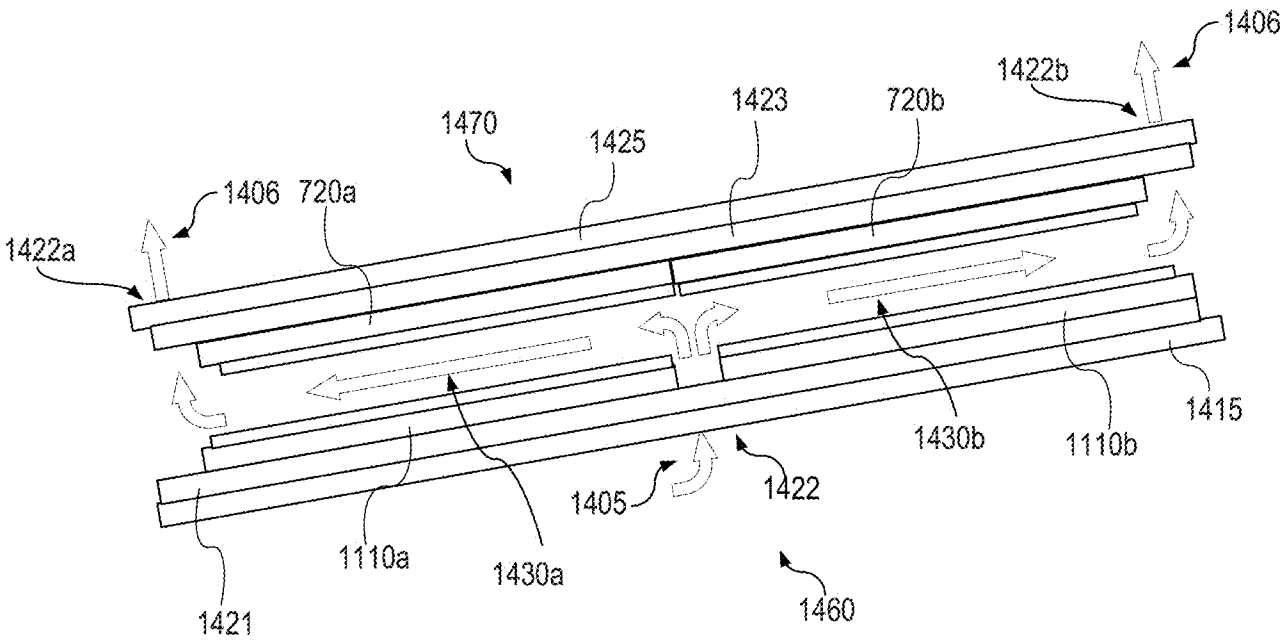
FIG. 14 is a simplified diagram illustrating feedstock flow for examples of rotor and stator elements having a common inlet opening according to some aspects of the present disclosure.

FIG. 14 is a simplified diagram illustrating feedstock flow for examples of rotor and stator elements having a common inlet opening according to some aspects of the present disclosure. Referring to FIG. 14, the rotor plate element 1360 may include rotor plate segments 1110*a*, 1110*b* coupled to attaching rails 1421. The stator element 1470 may include stator plate segments 770*a*, 770*b* coupled to attaching rails 1423 and the attaching rails 1421 may be coupled to the conical rotor support frame 1415. The stator plate segments 770*a*, 770*b* may be coupled to attaching rails 1423, and the attaching rails 1423 may be coupled to the conical stator support frame 1425. The feedstock 1405 may be conducted into the common inlet opening 1422 disposed at a location at an intermediate point between the rotor plate segments 1110*a*, 1110*b*.

As illustrated in FIG. 14, the feedstock 1405 may travel in one direction through the refining zone 1430*a* toward an end of the rotor plate segment 1110*a* and a corresponding end of the stator plate segment 720*a*. Concurrently, the feedstock 1405 may travel in an opposite direction through the refining zone 1430*b* toward an end opposite of the rotor plate segment 1110*b* and a corresponding end of the stator plate segment 720*b*. Refined feedstock 1406 from refining zones 1430*a*, 1430*b* may exit the conical refiner via outlet opening 1422*a* adjacent to the end of the stator plate segment 720*a* and refined feedstock 1406 from refining zones 1430*b* may exit the conical refiner via outlet opening 1422*b* adjacent to the end of the stator plate segment 720*b*.

In some implementations, feedstock may flow from the smaller end of the conical shape towards the larger end of the conical shape in all refining zones. In some implementations, the feedstock may flow from the larger end of the conical shape towards the smaller end of the conical shape in all refining zones. In some implementations, feedstock may flow from the smaller end of the conical shape towards the larger end of the conical shape in some refining zones, while feedstock may flow from the larger end of the conical shape towards the smaller end of the conical shape in other refining zones.

The examples and embodiments described herein are for illustrative purposes only. Various modifications or changes in light thereof will be apparent to persons skilled in the art. These are to be included within the spirit and purview of this application, and the scope of the appended claims, which follow.

What is claimed is:

1. A plurality of refiner plate elements for a conical mechanical refiner, the refiner plate elements comprising:

a rotor plate element comprising:

at least one rotor plate segment comprising:

at least one feedstock inlet opening disposed at a first end of the at least one rotor plate segment; and a rotor plate segment refining area disposed between the at least one feedstock inlet opening and a second end of the at least one rotor plate segment; and a stator plate element comprising:

at least one stator plate segment having a stator plate segment refining area;

a first attaching rail configured to couple to the at least one stator plate segment at a first edge portion of the at least one stator plate segment; and a second attaching rail configured to couple to the at least one stator plate segment at a second edge portion of the at least one stator plate segment opposite the first edge portion, wherein the first attaching rail and the second attaching rail are configured to attach the at least one stator plate segment to a stator support frame of the conical mechanical refiner, and wherein a separation between the first attaching rail and the second attaching rail that is not covered by the at least one stator plate segment is configured to form at least one feedstock outlet opening.

2. The refiner plate elements of claim 1, wherein the at least one rotor plate segment is disposed opposite the at least one stator plate segment such that the rotor plate segment refining area and the stator plate segment refining area oppose each other, and wherein the at least one feedstock inlet opening and the at least one feedstock outlet opening are separated by a refining zone formed by the rotor plate segment refining area and the stator plate segment refining area.

3. The refiner plate elements of claim 1, wherein the at least one feedstock outlet opening is formed at a separation between the first attaching rail and the second attaching rail adjacent to an end of the at least one stator plate segment.

4. The refiner plate elements of claim 1, wherein:

the at least one feedstock inlet opening is configured to conduct feedstock into a first end of a refining zone between the rotor plate segment refining area and the stator plate segment refining area, and the at least one feedstock outlet opening is configured to conduct refined feedstock out of a second end of the refining zone, wherein the at least one feedstock inlet opening is separated from the at least one feedstock outlet opening by the refining zone in an axial direction with respect to an axis of rotation of a rotor of the conical mechanical refiner.

5. The refiner plate elements of claim 1, wherein the rotor plate element is one of a plurality of rotor plate elements that are assembled on a conical rotor support frame to form a conical-shaped rotor, and the stator plate element is one of a plurality of stator plate elements that are assembled on the stator support frame having a conical shape, to form a corresponding conical-shaped stator surrounding the conical-shaped rotor.

6. The refiner plate elements of claim 1, wherein:

the at least one feedstock inlet opening of the rotor plate element permits feedstock to flow from a back side of the rotor plate segment into a refining gap formed by the rotor plate segment refining area and the stator plate segment refining area, and the at least one feedstock outlet opening of the stator plate element permits feedstock to flow from the refining gap to a backside of the stator plate segment.

7. The refiner plate elements of claim 1, wherein the at least one stator plate segment further comprises a blocking portion adjacent to the at least one feedstock inlet opening of the at least one rotor plate segment, and wherein the at least one rotor plate segment further comprises a blocking portion adjacent to the least one feedstock outlet opening of the at least one stator plate segment.

8. A rotor plate element for a conical mechanical refiner, the rotor plate element comprising:

at least one rotor plate segment having a rotor plate segment refining area;

a first attaching rail configured to couple to the at least one rotor plate segment at a first edge portion of the at least one rotor plate segment; and a second attaching rail configured to couple to the at least one rotor plate segment at a second edge portion of the at least one rotor plate segment opposite the first edge portion of the at least one rotor plate segment, wherein the first attaching rail and the second attaching rail are configured to attach the at least one rotor plate segment to a rotor support frame of the conical mechanical refiner, and wherein a separation between the first attaching rail and the second attaching rail that is not covered by the at least one rotor plate segment is configured to form at least one feedstock inlet opening.

9. The rotor plate element of claim 8, wherein the rotor plate element is one of a plurality of rotor plate elements that are assembled on a conical rotor support frame to form a conical-shaped rotor.

10. The rotor plate element of claim 8, wherein the at least one feedstock inlet opening is configured to conduct feedstock into a refining zone between the rotor plate segment refining area and a stator plate segment refining area.

11. The rotor plate element of claim 8, wherein the at least one rotor plate segment further comprises a blocking portion adjacent to at least one feedstock outlet opening of at least one stator plate segment.

* * * * *